US006164415A

United States Patent [19]

Takeuchi et al.

[11] Patent Number: 6,164,415

[45] Date of Patent: Dec. 26, 2000

[54] HYDRAULIC CONTROL APPARATUS FOR INDUSTRIAL VEHICLES

[75] Inventors: Toshiyuki Takeuchi; Yasuhiko Naruse; Takeharu Matsuzaki, all of Kariya; Makio Tsukada; Shigeto Nakajima, both of Nagano-ken, all of Japan

[73] Assignee: Kabushiki Kaisha Toyoda Jidoshokki Seisakusho, Kariya, Japan

[21] Appl. No.: 09/044,893

[22] Filed: Mar. 20, 1998

[30] Foreign Application Priority Data

| | | | |
|---|---|---|---|
| Mar. 21, 1997 | [JP] | Japan | 9-067706 |
| Mar. 24, 1997 | [JP] | Japan | 9-069364 |
| Mar. 24, 1997 | [JP] | Japan | 9-069376 |

[51] Int. Cl.[7] ..... B66F 9/22

[52] U.S. Cl. ..... 187/224; 187/275; 187/223; 414/636

[58] Field of Search ..... 187/222, 223, 187/224, 275; 414/631, 634, 635, 636; 701/50; 60/418

[56] References Cited

U.S. PATENT DOCUMENTS

| | | | |
|---|---|---|---|
| 3,842,943 | 10/1974 | Nakamura et al. | 187/275 |
| 3,942,413 | 3/1976 | Schwary et al. | 91/518 |
| 4,317,466 | 3/1982 | Ikeda et al. | 91/451 X |
| 4,411,582 | 10/1983 | Nakada | 187/224 X |
| 4,467,894 | 8/1984 | Sinclair | 187/224 |
| 4,491,918 | 1/1985 | Yuki et al. | 414/273 |
| 4,511,974 | 4/1985 | Nakane et al. | 414/634 X |
| 4,520,443 | 5/1985 | Yuki et al. | 414/273 X |
| 4,675,827 | 6/1987 | Narita et al. | 187/224 X |
| 4,930,975 | 6/1990 | Ito | 414/635 |
| 4,942,529 | 7/1990 | Avitan et al. | 414/636 X |
| 4,957,408 | 9/1990 | Ohkura | 414/635 |
| 4,995,517 | 2/1991 | Saotome | 91/437 X |
| 5,009,562 | 4/1991 | Hosotani et al. | 414/661 X |
| 5,034,892 | 7/1991 | Saotome | 701/50 |
| 5,048,294 | 9/1991 | Oshina et al. | 60/418 |
| 5,081,905 | 1/1992 | Yagyu et al. | 91/461 |
| 5,238,086 | 8/1993 | Aoki et al. | 187/223 |
| 5,329,441 | 7/1994 | Aoki et al. | 187/224 |
| 5,638,677 | 6/1997 | Hosono et al. | 60/431 |
| 5,692,377 | 12/1997 | Moriya et al. | 60/421 |
| 5,701,795 | 12/1997 | Friedrichsen | 91/446 |
| 5,797,262 | 8/1998 | Omoto | 60/410 |
| 5,947,516 | 9/1999 | Ishikawa | 187/222 X |

FOREIGN PATENT DOCUMENTS

| | | |
|---|---|---|
| 0 498 611 A2 | 8/1992 | European Pat. Off. . |
| 56-39309 | 4/1981 | Japan . |
| 56-39311 | 4/1981 | Japan . |
| 63-134724 | 6/1988 | Japan . |
| 4-256698A | 9/1992 | Japan . |
| 5-229792 | 9/1993 | Japan . |
| 5-229792A | 9/1993 | Japan . |
| 7-61791 | 3/1995 | Japan . |
| 7-97198 | 4/1995 | Japan . |
| 8-229995 | 9/1996 | Japan . |
| 9-77495 | 3/1997 | Japan . |
| 10-291796 | 11/1998 | Japan . |
| 2 269 425 | 2/1994 | United Kingdom . |

OTHER PUBLICATIONS

Patent Abstracts of Japan, Publication No. 09025099, published Jan. 28, 1997, Automatic Tilt Angle Adjusting Device.

*Primary Examiner*—Dean J. Kramer
*Assistant Examiner*—Thuy V. Tran
*Attorney, Agent, or Firm*—Morgan & Finnegan, L.L.P.

[57] ABSTRACT

A lift control valve is switched based on the manipulation of a lift lever, so that a lift cylinder extends or retracts to move a fork, supported on a mast, to move up or down. A check valve, which is actuated with a pilot pressure, is placed between the lift control valve and the lift cylinder. A pilot pipe led out from a pipe directly coupled to an oil tank is connected to a port of the check valve. A tilt control valve is switched based on the manipulation of a tilt lever, so that a tilt cylinder extends or retracts to tilt the mast. An electromagnetic valve is disposed between the tilt cylinder and the tilt control valve. When values necessary to drive the fork are detected, a controller control the electromagnetic valve based on those values.

24 Claims, 11 Drawing Sheets

HYDRAULIC CONTROL APPARATUS FOR INDUSTRIAL VEHICLES

BACKGROUND OF THE INVENTION

1. Field of the Invention

The present invention relates generally to a hydraulic control apparatus for industrial vehicles like a forklift. More particularly, this invention relates to a hydraulic control apparatus for use in industrial vehicles to operate an attachment like a forklift in accordance with the manipulation of an operational lever.

2. Description of the Related Art

As an operator manipulates the lift lever of a forklift, a lift cylinder expands or retracts to move the fork up or down. As a tilt lever is manipulated, the tilt cylinder expands or retracts to incline the mast. A vehicle such as a forklift is equipped with a hydraulic control apparatus for controlling the actuation of the lift cylinder and tilt cylinder.

As shown in FIG. 15, the actuations of a lift cylinder 161 and a tilt cylinder 162 of a forklift are controlled by a lift control valve 163 and a tilt control valve 164, respectively. The lift control valve 163 is manually operated by a lift lever 165, and the tilt control valve 164 is also manually operated by a tilt lever 166. The lift control valve 163 has a spool which moves in accordance with the up, neutral and down positions of the lift lever 165. The lift control valve 163 is connected via a pipe 167 to a bottom chamber 161*a* of the lift cylinder 161. The lift control valve 163 is connected to a hydraulic pump (not shown) via a pipe 163*a* and to an oil tank (not shown) via a return pipe 168*b*. The lift control valve 163 connects the pipe 168*a* to the pipe 167 when the lift lever 165 is moved to the up position, and connects the pipe 168*b* to the pipe 167 when the lift lever 165 is moved to the down position. When the lift lever 165 is moved to the neutral position, the lift control valve 163 disconnects the pipe 167 from the pipe 168*a* and the return pipe 168*b*, and holds a piston rod 161*b* at a predetermined position.

The down movement of the fork by the lift cylinder 161 is carried out as the piston rod 161*b* is moved down due to the pressure applied by the weight of the fork and the mast or the like. When the lift lever 165 is moved to the down position and the bottom chamber 161*a* of the lift cylinder 161 is connected to the oil tank, the fork moves downward even with the hydraulic pump stopped. As a third person or an operator accidentally manipulates the lift lever 165 to the down position while the forklift is not in operation (i.e., the engine is stopped or the power switch is off for a battery-driven vehicle) with the fork placed at the up position and the operation of the lift cylinder 161 stopped, therefore, the fork undesirably moves downward.

With the fork loaded, the center of gravity of the forklift moves frontward, and the moment which acts on the mast increases as the fork's position moves upward. As the mast is inclined frontward in a loaded condition, the center of gravity moves further forward, and thus the forward and backward stabilities of the forklift get lower.

If the rearward tilt angle is increased in a heavily loaded condition in order to cope with this situation, the center of gravity moves too rearward, lifting up the front wheels a little and the forklift may slip. In this respect, the frontward tilt angle and rearward tilt angle of the mast are set to predetermined values. While it is typical to set the frontward tilt angle to six degrees and the rearward tilt angle to twelve degrees, some forklifts specially designed with a high mast have the frontward tilt angle set to three degrees and the rearward tilt angle set to six degrees.

To put loads at a high place in an unloading work, the mast should be tilted forward while the fork is held at a high position. If the mast is tilted forward too much at a fast tilting speed due to some inadequate manipulation, loads may fall off or the rear wheels of the forklift may be lifted (i.e., instability in the forward and backward directions of the vehicle may occur). This compels the operator to carefully incline the mast at a low speed by such an inching manipulation as not to tilt the mast too frontward, and thus puts a great psychological burden on the operator. Further, tilting the mast forward with the fork held at a high position requires skills.

There are two main ways known to open and close the hydraulic passages of the lift cylinder and tilt cylinder in accordance with the manipulation of the lift lever and the tilt lever. One method uses a manual control valve (manual changeover valve) which is manually switched by the operation of a lever. The other one is to electrically detect the manipulation of a lever and switch an electromagnetic valve based on the detection by means of a controller (see Japanese Unexamined Patent Publication No. Hei 7-61792, for example).

In an apparatus disclosed in, for example, Japanese Unexamined Patent Publication No. Hei 7-61792, the controller controls an electromagnetic control valve independently of the operator's manipulation of the load lever. This accomplishes such control as to stop the fork in the horizontal position and control on the angle of the electromagnetic valve which is provided on the hydraulic passage of the tilt cylinder for controlling the flow rate. Regardless of the difference between the manual control valve and the electromagnetic control valve, sticking which causes over-friction between the spool and the body of the valve may occur due to thermal expansion originated from an increase in the temperature of a hydraulic fluid or foreign matter mixed in the oil which has entered between the spool and body. Even if sticking occurs, the use of the manual control valve allows the operator to accomplish valve switching by manipulating the load lever with a little stronger force. According to the electric control system, however, if there is a frictional resistance higher than the spool drive force which is determined from a predetermined current value previously set to actuate the electromagnetic valve, the actuation of the electromagnetic valve becomes disabled. Even if the lever is manipulated, therefore, the tilt cylinder may not move in that case.

As one way to avoid such a situation, a larger clearance may be secured between the spool and body of the electromagnetic valve so that sticking hardly occurs. This scheme however has its limitation, and increasing the clearance raises a new problem of leakage of the hydraulic fluid.

As the manual control system is generally used, the use of the electromagnetic-valve based system in the hydraulic control apparatus requires a considerable design change such as replacement of the manual control valve with the electromagnetic valve, and, what is more, the conventional components like the manual control valve unfortunately cannot be utilized. Moreover, the structure which uses the electromagnetic valve can carry out halt control of the fork and mast by controlling the closing of the electromagnetic valve, but requires separate electromagnetic valves for flow-rate regulation on the hydraulic passages of the fork and mast in order to control their speeds. This complicates the hydraulic circuit and control, disadvantageously.

SUMMARY OF THE INVENTION

Accordingly, it is a primary object of the present invention to provide a hydraulic control apparatus for industrial vehicles, which has a simple hydraulic circuit constitution and can prevent a loading unit from being non-operational due to valve sticking.

It is another object of this invention to accomplish opening and closing control on the hydraulic passages of hydraulic cylinders to stop a loading unit in a horizontal posture.

It is a different object of this invention to control the flow rates in the hydraulic passages of hydraulic cylinders to restrict the rearward tilt angle of the mast in accordance with the height of the mast.

It is a further object of this invention to control the flow rates in the hydraulic passages of hydraulic cylinders to absorb shocks at the time the mast stops at a predetermined halt angle.

In accordance with the present invention, a hydraulic control apparatus for an industrial vehicle for tilting a loading attachment supported on a mast by operating operation means to switch a changeover valve to control a hydraulic cylinder, comprises an electromagnetic valve placed between the hydraulic cylinder and the changeover valve. Detection means for detecting a value necessary to manipulate the attachment and control means for controlling the electromagnetic valve based on the detected value are provided.

Also in accordance with the present invention, a hydraulic control apparatus for an industrial vehicle for moving a loading attachment supported on a mast up and down by operating operation means to switch a changeover valve to control a hydraulic cylinder, comprises a hydraulic pump, a check valve between the hydraulic cylinder and the changeover valve, and check valve relief means for relieving the check valve only when the hydraulic pump is driven.

It is a yet further object of this invention to prevent a loading unit from moving due to its weight when someone accidentally manipulates an operational section while its key is set off.

It is a still further object of this invention to suppress the natural down movement and natural forward tilting of a loading unit.

It is a yet still further object of this invention to improve the positioning precision at the time of performing halt control on a loading unit.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

First Embodiment

A first embodiment of the present invention as embodied in a hydraulic control apparatus for a load work for a forklift will be described below referring to FIGS. 1 through 6.

Figure 4:
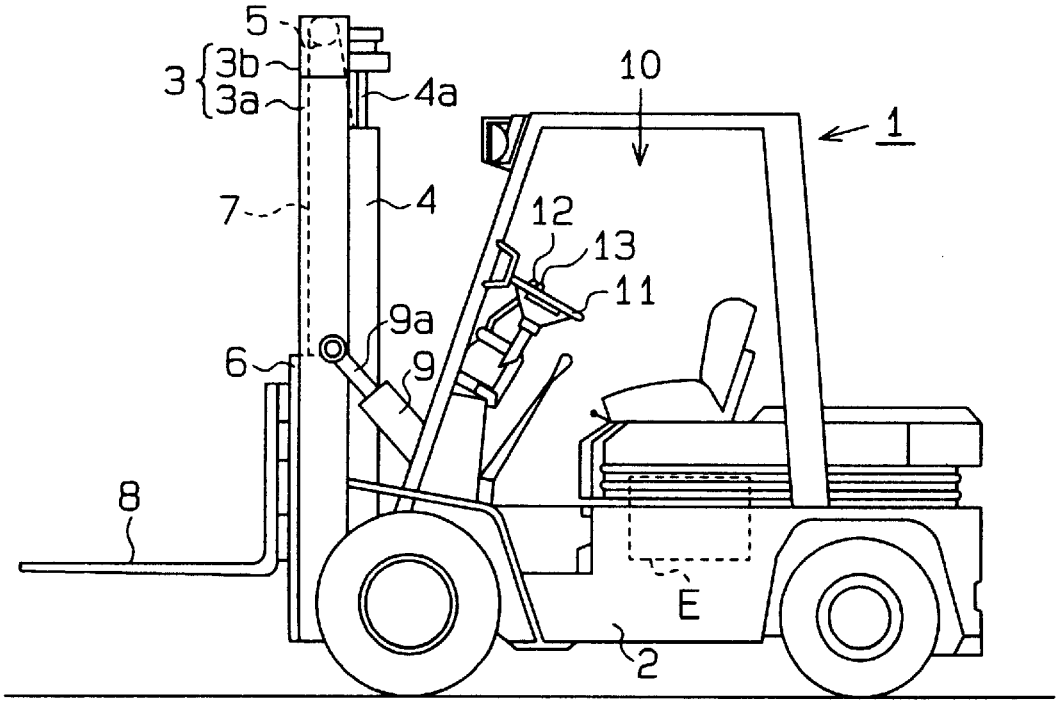
FIG. 4 is a side view of the forklift.
Figure 5:
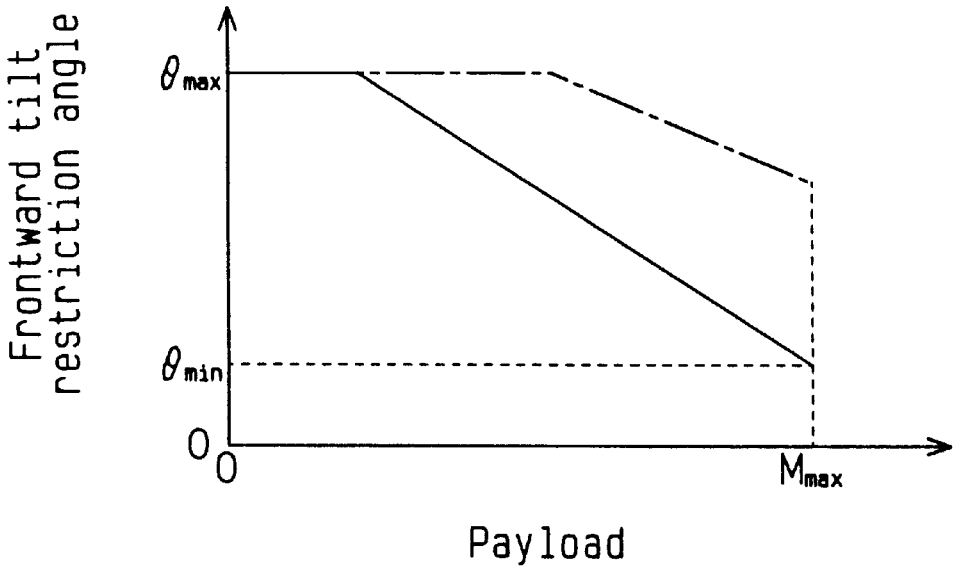
FIG. 5 is a chart showing a map for front-tilt-angle regulation control.

As shown in FIG. 4, a body frame 2 of a forklift 1 has a mast 3 provided in a standing manner at its front portion. The mast 3 comprises a pair of right and left outer masts 3*a* which are supported tiltable frontward and rearward to the body frame 2, and an inner mast 3*b* which moves up and down while sliding along the outer masts 3*a*. A lift cylinder 4 is provided at the rear portion of each outer mast 3*a*. The distal end of a piston rod 4*a* of the lift cylinder 4 is coupled to the upper portion of the inner mast 3*b*. A around chain wheels 5' supported at the upper portion of the inner mast 3*b*' are chains 7 which each have one end secured to the upper portions of the bodies of the lift cylinders 4 or the outer masts 3*a*, and the other ends to lift brackets 6. A fork 8 as a loading unit moves up and down together with the lift brackets 6 suspended from the chains 7 as the lift cylinders 4 expand and retract.

The mast 3 is coupled and supported tiltable to the body frame 2 via a pair of right and left tilt cylinders 9. Each tilt cylinder 9 has its proximal end coupled rotatable to the body frame 2 and is rotatably coupled to the associated outer mast 3*a* at the distal end of its piston rod 9*a*. The mast 3 inclines frontward and rearward as the tilt cylinders 9 expand and retract.

A steering wheel 11, a lift lever 12 and a tilt lever 13 are installed at the front portion of a driver's room 10 (both levers 12 and 13 shown one on the other in FIG. 4). The lift lever 12 is to be manipulated to lift the fork up or down, while the tilt lever 13 is to be manipulated to tilt the mast 3.

Figure 3:
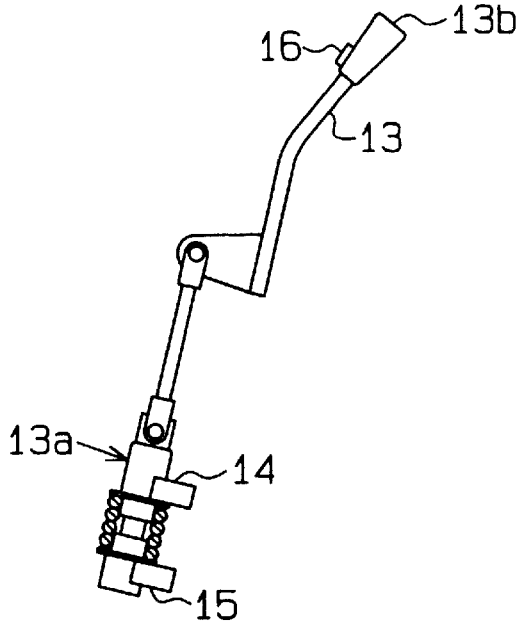
FIG. 3 is a side view of a tilt lever.

Provided in the vicinity of an operational force transmission mechanism 13*a* of the tilt lever 13 are a frontward tilt detection switch 14 for detecting the manipulation of the tilt lever 13 for the frontward inclination and a rearward tilt detection switch 15 for detecting the manipulation of the tilt lever 13 for the rearward inclination, as shown in FIG. 3. Both switches 14 and 15 may be comprised of micro switches. The frontward tilt detection switch 14 is set on when the tilt lever 13 is manipulated for the frontward tilt action, and the rearward tilt detection switch 15 is set on when the tilt lever 13 is manipulated for the rearward tilt action. With the tilt lever 13 at the neutral position, both switches 14 and 15 are set off.

A knob 13*b* of the tilt lever 13 is provided with an operation switch 16 which an operator manipulates to automatically stop the fork 8 at a horizontal position at the time of manipulating the tilt lever 13.

Figure 2:
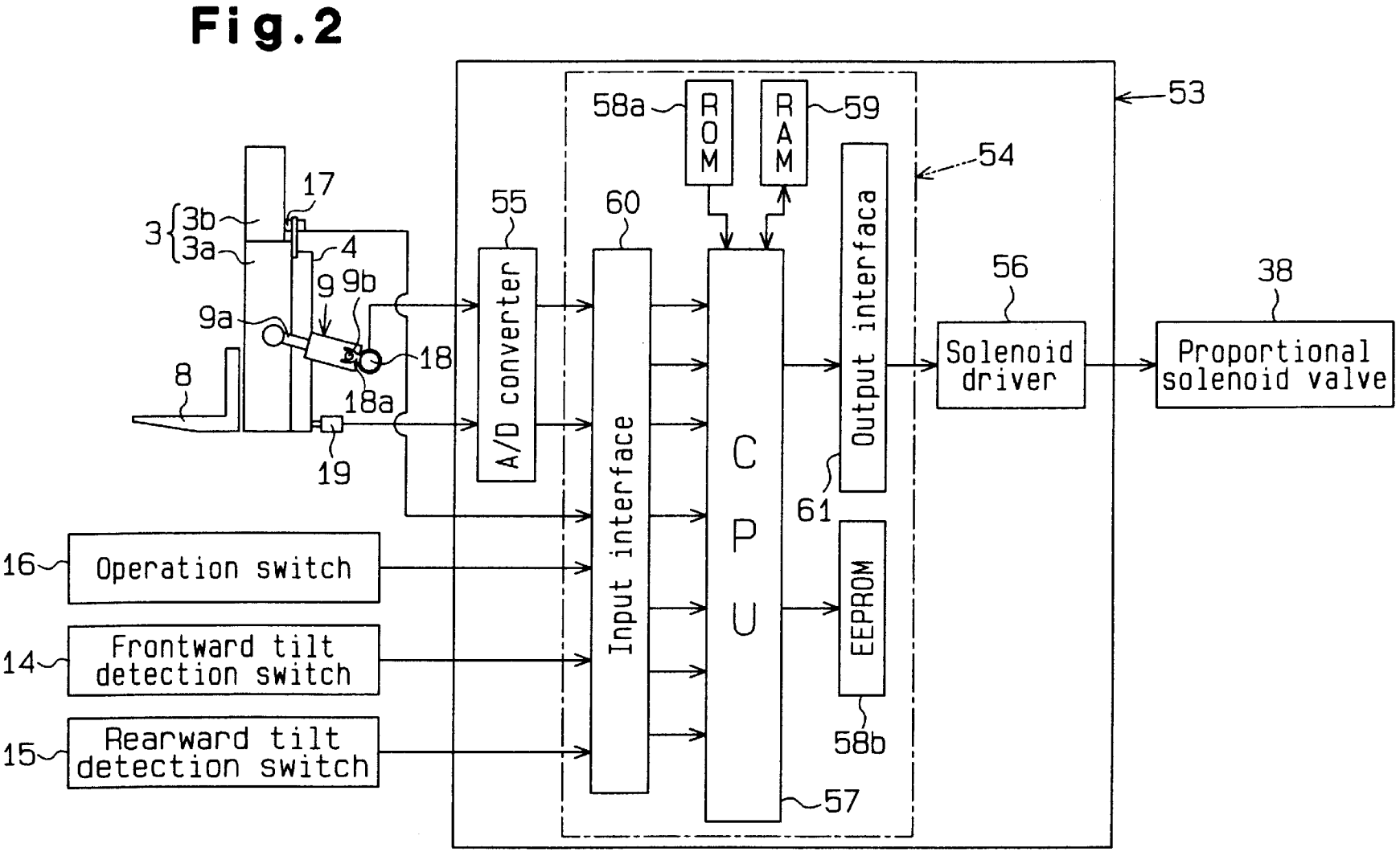
FIG. 2 is an electric circuit block diagram of a forklift according to the first embodiment.

As shown in FIG. 2, a height sensor 17 is provided at the upper portion of the outer mast 3*a*. The height sensor 17 is a proximity sensor, for example. The height sensor 17 is set on when the fork 8 is positioned at or above a predetermined height, and it is set off when the fork 8 is positioned below the predetermined height. Provided on the body frame 2 are rotary potentiometers 18 each of which detects the poise angle of the associated tilt cylinder 9 to thereby indirectly detect the tilt angle of the mast 3. A rotatable piece 18*a* rotatably secured to the input shaft of the potentiometer 18 holds a pin 9*b* protruding from the associated tilt cylinder 9, and the potentiometer 18 outputs a detection signal according to the poise angle of the tilt cylinder 9. Provided at the lower portion of each lift cylinder 4 is a pressure sensor 19 for sensing the hydraulic pressure in a bottom chamber 4*b* of that lift cylinder 4. Each pressure sensor 19 outputs a detection signal according to the payload of the fork 8.

Figure 1:
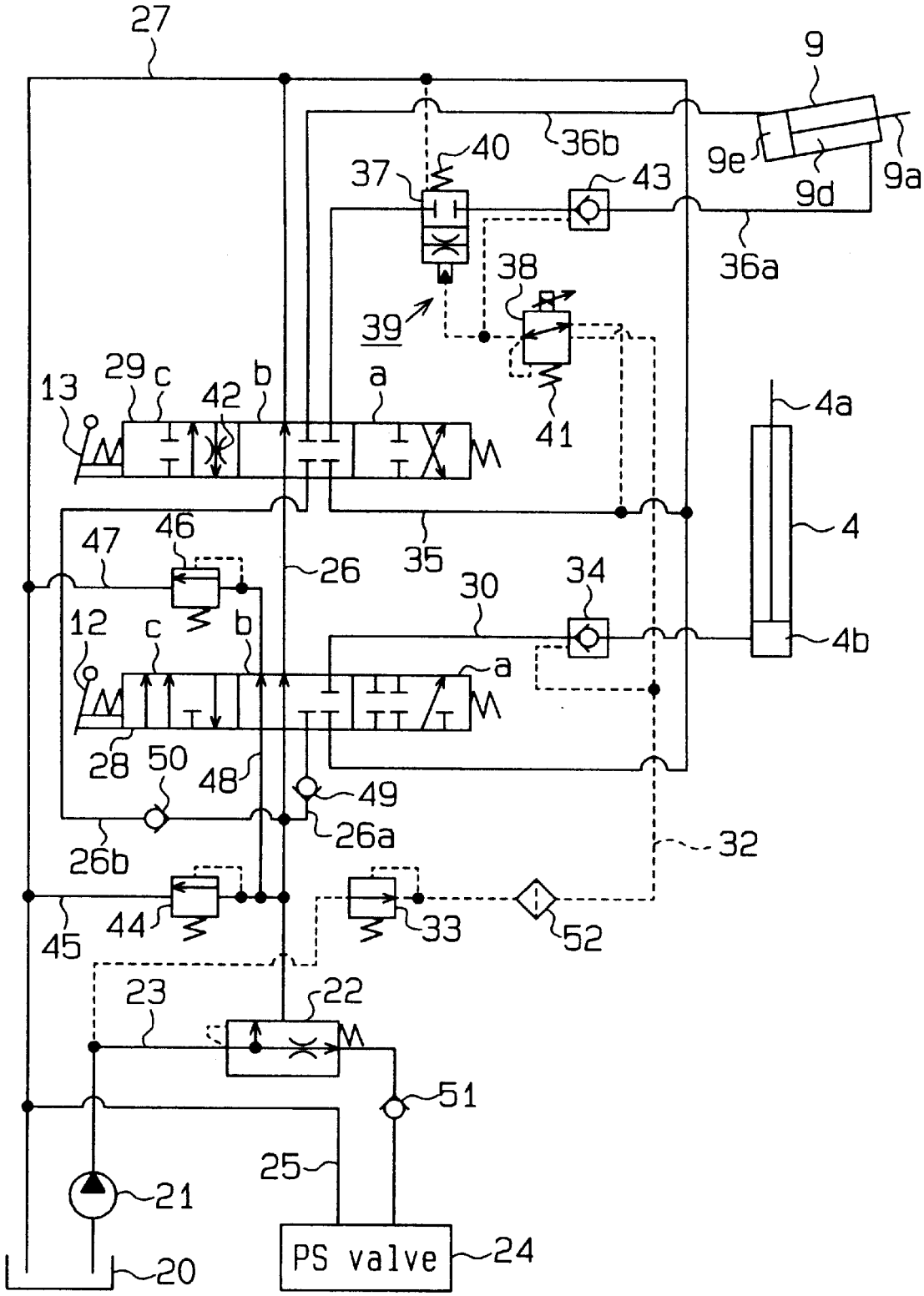
FIG. 1 is a hydraulic circuit diagram of a forklift illustrating a first embodiment of this invention.

FIG. 1 illustrates the hydraulic circuit of a loading system installed on the forklift 1.

As shown in FIG. 1, a hydraulic pump 21 for pumping a hydraulic fluid out of the oil tank 20 and supplying the hydraulic fluid to the individual cylinders 4 and 9 is driven by an engine E (shown in FIG. 4). The hydraulic fluid from the hydraulic pump 21 is supplied to a flow divider 22 via a pipe 23. The flow divider 22 serves to increase the pressure of the hydraulic fluid from the hydraulic pump 21 to or above a predetermined pressure, then separately supplies the hydraulic fluid to the hydraulic circuit of the loading system and the hydraulic circuit of the steering system. The pressurized hydraulic fluid distributed to the steering system from the flow divider 22 is returned to the oil tank 20 via a pipe 25 which passes through a steering valve 24.

A hydraulic fluid supply pipe 26 through which the pressurized hydraulic fluid distributed to the loading system from the flow divider 22 passes is connected to a return pipe 27 which returns to the oil tank 20, with a lift control valve 28 as a second manual changeover valve and a tilt control valve 29 as a manual changeover valve disposed in series on this hydraulic fluid supply pipe 26.

The lift control valve 28 is a 7-port, 3-position changeover valve whose spool is mechanically and functionally coupled to the lift lever 12. As the lift lever 12 is manipulated to the up position, neutral position or down position, the lift control valve 28 can be manually switched to one of three states a, b and c.

Connected to the control valve 28 are a branch pipe 26*a* branched from the hydraulic fluid supply pipe 26, the return pipe 27 and a pipe 30 connected to the bottom chamber 4*b* of the lift cylinder 4. When the lift control valve 28 is switched to the position a (up position), the branch pipe 26*a* is connected to the pipe 30 to supply the hydraulic fluid to the bottom chamber 4*b*, thus causing the lift cylinder 4 to stretch. When the lift control valve 28 is switched to the position c (down position), the pipe 30 is connected to the return pipe 27 to discharge the hydraulic fluid from the bottom chamber 4*b* into the oil tank 20 via the pipes 30 and 27, thus causing the lift cylinder 4 to retract. With the lift control valve 28 at the position b (neutral position), the pipe 30 is cut from the pipes 26*a* and 27, and the piston rod 4*a* of the lift cylinder 4 is held protruding by a predetermined protrusion amount. At the position c, the hydraulic fluid in the bottom chamber 4*b* is discharged by the load pressure that acts on the piston rod 4*a*.

Connected to the pipe 23 is a pressure transmission pipe 32 for transmitting the discharge pressure of the hydraulic pump 21 to use it in pilot control. A pressure reducing valve 33 provided on the pressure transmission pipe 32 serves to regulate the discharge pressure of the hydraulic pump 21 to a predetermined pilot pressure (set pressure). A pilot check valve 34 as a second pilot check valve, which is disposed on the pipe 30, operates by the hydraulic pressure from the pressure transmission pipe 32, and is kept open when that hydraulic pressure becomes equal to or greater than a predetermined pressure after the engine has started (e.g., after one to two seconds). That is, the pilot check valve 34 is held closed at the key-off time (engine stopped), and opens for the first time upon key-on (engine started), thereby inhibiting the flow-out of the hydraulic fluid from the bottom chamber 4*b* in the key-off state.

The tilt control valve 29 is a 6-port, 3-position changeover valve whose spool is mechanically and functionally coupled to the tilt lever 13. As the tilt lever 13 is manipulated to the rearward tilt position, neutral position or frontward tilt position, the tilt control valve 29 can be manually switched to one of three states a, b and c. Connected to the tilt control valve 29 are a branch pipe 26*b* branched from the hydraulic fluid supply pipe 26, an exhaust pipe 35 linked to the return pipe 27, a pipe 36*a* linked to a rod chamber 9*d* as a chamber in the tilt cylinder 9, and a pipe 36*b* coupled to a bottom chamber 9*e*.

Provided on the pipe 36*a* is an electromagnetic valve 39 as an electromagnetic proportional control valve, which is comprised of a control valve 37 for opening and closing the hydraulic passage of the hydraulic fluid that flows through the pipe 36*a* and a proportional solenoid valve 38 for controlling the pilot pressure to actuate this control valve 37. The electromagnetic valve 39 is provided on the hydraulic passage of the tilt system in order to perform halt control and speed control on the mast 3, which are carried out independently of the manipulation of the tilt lever 13 and which will be discussed later. The angle of the control valve 37 is controlled by the value of the current which flows through the proportional solenoid valve 38 (solenoid current value).

The control valve 37 is a 2-port, 2-position one-way valve which is closed by the urging force of a spring 40 when the pilot pressure is lower than a predetermined value. The proportional solenoid valve 38 is a normally closed valve which is closed by the urging force of a spring 41 when the solenoid current value is smaller than a predetermined value Io. The proportional solenoid valve 38, connected to the pressure transmission pipe 32, applies a pilot pressure corresponding to the valve angle, which is determined by that current value, to the control valve 37. The reason for the separation of the electromagnetic valve 39 into the control valve 37 and the proportional solenoid valve 38 is because this structure needs a smaller solenoid current for control than the one that is needed in the structure that employs a direct acting valve.

With the control valve 37 open, when the tilt control valve 29 is switched to the position a (rearward tilt position), the pipes 26*b* and 36*a* are connected together to supply the hydraulic fluid to the rod chamber 9*d*, and the pipes 36*b* and 35 are connected together to discharge the hydraulic fluid from the bottom chamber 9*e* into the oil tank 20 via the pipes 36*b*, 35 and 27. This causes the tilt cylinder 9 to retract. When the tilt control valve 29 is switched to the position c (frontward tilt position) with the control valve 37 open, the pipes 26*b* and 36*b* are connected together to supply the hydraulic fluid to the bottom chamber 9*e*, and the pipes 36*a* and 35 are connected together to discharge the hydraulic fluid from the rod chamber 9*d* into the oil tank 20 via the pipes 36*a*, 35 and 27. This causes the tilt cylinder 9 to extend. When the tilt control valve 29 is at the position b (neutral position), the pipes 36*a* and 36*b* are respectively disconnected from the pipes 26*b* and 35, and the piston rod 9*a* of the tilt cylinder 9 is held protruding by a predetermined protrusion amount. With the tilt control valve 29 at the position c (frontward tilt position), the flow passage is restricted by an orifice 42, so that the frontward tilt speed of the mast 3 is set to become relatively slower than the rearward tilt speed.

A pilot check valve 43 is disposed on the pipe 36*a* between the control valve 37 and the tilt cylinder 9, in such a direction as to inhibit the flow-out of the hydraulic fluid from the rod chamber 9*d* in the closed state. The pilot check valve 43 is actuated with the same pilot pressure that activates the control valve 37, and is so set as to be open with a lower pilot pressure than the one at which the control valve 37 starts opening.

A relief valve 44 is provided on a pipe 45 which connects the hydraulic fluid supply pipe 26 to the return pipe 27, and a relief valve 46 is disposed on a pipe 47 which connects the lift control valve 28 to the return pipe 27. The pipe 47 is to be connected to a branch pipe 48 branched from the pipe 45 when the lift control valve 28 is at either the position b (neutral position) or the position c (down position) where the hydraulic fluid supply pipe 26 is not blocked.

With the lift control valve 28 switched to the position a (up position) to block the hydraulic fluid supply pipe 26, the relief valve 44 allows the hydraulic fluid to escape so that the pressurized fluid flowing in the passage of the lift system becomes a lift set pressure. With the tilt control valve 29 switched to either the position a (rearward tilt position) or the position c (frontward tilt position) where the hydraulic fluid supply pipe 26 is blocked, the relief valve 46 allows the hydraulic fluid to escape so that the pressurized fluid flowing in the passage of the tilt system becomes a tilt set pressure. The check valves 49, 50 and 51 serve to inhibit the counterflow of the hydraulic fluid. A filter 52 is provided to filter out foreign matters in the fluid for the very delicate proportional solenoid valve 38. The pipes 26*b*, 36*a*, 36*b* and 35 constitute the passage of the tilt system.

The electric constitution of this hydraulic control apparatus will be described below.

As shown in FIG. 2, a controller 53 as control means for controlling the angle of the control valve 37 or the output pilot pressure of the proportional solenoid valve 38, automatic horizontal halt means, rearward tilt speed control means and shock absorbing control means comprises a microcomputer 54, an analog-to-digital (A/D) converter 55 and a solenoid driver 56. The microcomputer 54 has a central processing unit (CPU) 57, a read only memory (ROM) 58*a*, an EEPROM (Electrically Erasable Programmable ROM) 58*b*, a random access memory (RAM) 59, an input interface 60 and output interface 61.

The ROM 58*a* is storing (holding) data necessary at the time of running various kinds of control programs and programs. Stored in the EEPROM 58*b* are maps representing the relationship among the elevation height and the payload and the maximum allowable frontward tilt angle (hereinafter called frontward tilt restriction angle) as data needed to run a frontward tilt angle restriction control program. There are two kinds of maps prepared for the case where the fork is positioned higher than a predetermined position (solid line) and the case where the fork is positioned lower than the predetermined position (chain line) as shown in, for example, FIG. 5, so that the frontward tilt restriction angle is set in accordance with the payload for each case.

A horizontal set angle is stored in the EEPROM 58*b* as data necessary to run an automatic horizontal halt control program. The horizontal set angle is a value equivalent to the value that is detected by the potentiometer 18 when the fork 8 is in a horizontal posture.

Figure 6:
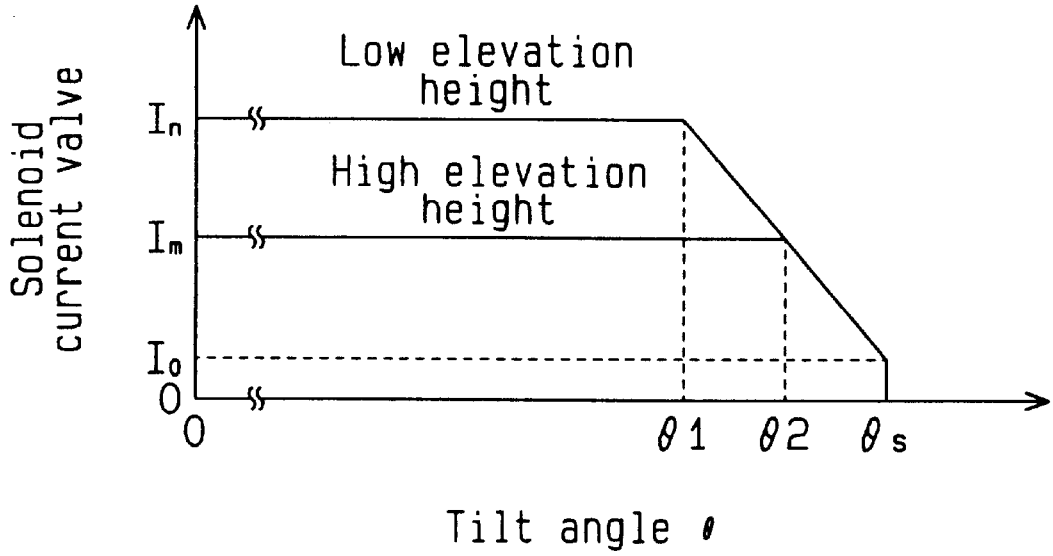
FIG. 6 is a chart showing a map for rear-tilt-angle regulation control and shock absorbing control.

Also stored in the EEPROM 58*b* is a map representing the relationship between the fork's height and the solenoid current value as data needed to run a rearward tilt speed control program. The solenoid current value is a current value for controlling the proportional solenoid valve 38, and the angle of the control valve 37 is controlled in such a way as to be substantially proportional to this current value. As shown in FIG. 6, the solenoid current value is set to a current value In when the fork's position is low and to a current value Im (In>Im) when the fork's position is high, so that the rearward tilt speed of the mast 3 is switched in two steps in accordance with the elevation height.

Further stored in the EEPROM 58*b* is a deceleration start angle necessary to run a shock absorbing control program. The shock absorbing control decelerates the mast 3 before a predetermined halt angle to absorb shocks at the time the mast 3 stops. In this embodiment, the deceleration start angle, which is determined for each halt angle from the tilt speed of the mast 3 before deceleration starts, is set in such a manner that the speed of the mast 3 becomes "0" at the predetermined halt angle when the mast 3 is decelerated at a given deceleration speed (inclination). This deceleration start angle is set for each of halt angles such as the frontward tilt restriction angle, horizontal set angle and rearward tilt restriction angle (the mast tilt angle when the rearward inclination of the tilt cylinder 9 ends). When the mast 3 is inclined rearward, for example, the rearward tilt speed is switched in two steps in accordance with the elevation height, so that the deceleration start angles $\theta 1$ and $\theta 2$ according to the rearward tilt speed are set with respect to the halt angle (horizontal set angle or the rearward tilt restriction angle) $\theta s$, as shown in FIG. 6. Note that in the light of the vehicle type, the use purpose of the vehicle and a variation in machine precision, the data in the EEPROM 58*b* can be set machine by machine by operating a setting operation section (not shown).

The potentiometer 18 and the pressure sensor 19 are connected to the CPU 57 via the A/D converter 55 and the input interface 60. The height sensor (proximity sensor) 17, the frontward tilt detection switch 14, the rearward tilt detection switch 15 and the operation switch 16 are connected via the input interface 60 to the CPU 57.

The solenoid driver 56 is connected via the output interface 61 to the CPU 57. The CPU 57 sends an instruction value for specifying a solenoid current value for the current value control on the proportional solenoid valve 38 to the solenoid driver 56. Based on the instruction value, the solenoid driver 56 controls the current that flows in the proportional solenoid valve 38.

The operation of the thus constituted hydraulic control apparatus will now be discussed.

At the key-off (engine stopped) time, the hydraulic pump 21 is stopped and the hydraulic pressure in the pressure transmission pipe 32 is low, so that the pilot check valves 34 and 43 are held closed. At the key-off time, therefore, the natural downward movement of the fork 8 and the natural frontward inclination of the mast 3 are surely prevented. Even if any person accidentally manipulates the lift lever 12 at the key-off time, the closed pilot check valve 34 prevents the fork 8 from moving downward. Even if any person accidentally manipulates the tilt lever 13 at the key-off time, the closed control valve 37 and pilot check valve 43 prevent the mast 3 from tilting forward.

When the forklift is switched on (key-on), the engine E starts and the actuation of the hydraulic pump 21 begins. When the hydraulic pressure in the pressure transmission pipe 32 goes up to or above a predetermined level after the engine has started, the pilot check valve 43 is opened. After one to two seconds, for example, after the ignition of the engine, the hydraulic pressure in the pressure transmission pipe 32 reaches the pilot set pressure. The hydraulic fluid expelled from the hydraulic pump 21 is pressurized to a predetermined pressure by the flow divider 22, and then is distributed to the loading system and the steering system. In the situation in FIG. 1 where the levers 12 and 13 are at the neutral positions, the hydraulic fluid distributed to the loading system passes through the control valves 28 and 29 provided on the hydraulic fluid supply pipe 26, and then circulates back to the oil tank 20 via the return pipe 27.

When the lift lever 12 is manipulated for the lift-up operation in this circumstance, the lift control valve 28 is switched to the state a, allowing the hydraulic fluid to be supplied to the bottom chamber 4*b* from the hydraulic fluid supply pipe 26 via the pipes 26*a* and 30. As a result, the lift cylinder 4 extends to lift up the fork 8. When the lift lever 12 is manipulated for the lift-down operation, the lift control valve 28 is switched to the state c, and the hydraulic fluid is discharged from the bottom chamber 4*b* to the oil tank 20 through the pipes 30 and 27. Consequently, the lift cylinder 4 retracts to move the fork 8 downward.

When the tilt lever 13 is manipulated, the tilt control valve 29 is switched to either the state a or the state c. When one of the detection switches 14 and 15 is set on then, the CPU 57 sends an instruction value corresponding to the then manipulation direction or the like to the solenoid driver 56 unless the tilt angle of the mast 3 based on the detection value from the potentiometer 18 is a specific halt angle (frontward tilt restriction angle). The solenoid driver 56 supplies a solenoid current according to this instruction value to the proportional solenoid valve 38, which is in turn opened by an angle corresponding to that current value. Then, the pilot pressure according to the angle of the proportional solenoid valve 38 is applied to the control valve 37 and the pilot check valve 43, opening both valves 37 and 43 by an angle corresponding to that pilot pressure. This way, the angle of the control valve 37 is controlled indirectly by controlling the current value for the proportional solenoid valve 38 by the CPU 57. When the tilt lever 13 is at the neutral position and the control valve 37 need not be opened, the detection switches 14 and 15 are both disabled to block the current flow to the proportional solenoid valve 38, thus reducing the power dissipation.

When the tilt lever 13 is manipulated for the frontward tilt operation, the control valve 37 is fully opened. When the tilt lever 13 is manipulated for the rearward tilt operation, the control valve 37 is switched in two steps in accordance with the then elevation height as will be discussed later. When the tilt control valve 29 is switched to the state a, the hydraulic fluid in the hydraulic fluid supply pipe 26 is supplied to the rod chamber 9*d* from the branch pipe 26*b* via the pipe 36*a* and the hydraulic fluid in the bottom chamber 9*e* is discharged into the oil tank 20 via the pipes 36*b*, 35 and 27. As a result, the tilt cylinder 9 retracts to tilt the mast 3 rearward. When the tilt control valve 29 is switched to the state c, the hydraulic fluid in the hydraulic fluid supply pipe 26 is supplied to the bottom chamber 9*e* from the branch pipe 26*b* via the pipe 36*b* and the hydraulic fluid in the rod chamber 9*d* is discharged into the oil tank 20 via the pipes 36*a*, 35 and 27. Consequently, the tilt cylinder 9 extends to tilt the mast 3 frontward. At this time, the orifice 42 restricts the hydraulic fluid so that the forward inclination of the mast 3 is carried out at a relatively low speed. By contrast, the backward inclination of the mast 3 is carried out at a relatively high speed in order to give priority to the work efficiency.

A description will now be given of various controls of the tilt system, one by one, which are executed as the CPU 57 performs current value control on the electromagnetic valve 39 (i.e., the proportional solenoid valve 38).

(A) The frontward tilt angle restriction control of the mast will be discussed below.

The CPU 57 performs this frontward tilt angle restriction control when the tilt lever 13 is manipulated for the frontward tilt operation and the frontward tilt detection switch 14 is set on. The CPU 57 determines the position when the height sensor 17 is set on as a high position, and the position when the height sensor 17 is set off as a low position. At the high position, the frontward tilt restriction angle according to the detection value from the pressure sensor 19 (payload value) by using the map (solid line) for the high position, one of the two maps shown in FIG. 5. At the low position, on the other hand, the frontward tilt restriction angle according to the detection value from the pressure sensor 19 by using the other map (chain line) for the low position shown in FIG. 5.

While the mast 3 is tilted forward by the frontward tilt manipulation of the tilt lever 13, the CPU 57 monitors the tilt angle based on the detection signal from the potentiometer 18. Then, the CPU 57 performs halt control to stop the inclination of the mast 3 when the tilt angle reaches the previously calculated frontward tilt restriction angle that is determined by the then height and load of the fork 8. In other words, the CPU 57 stops the current flowing to the proportional solenoid valve 38 to close the control valve 37, thereby stopping the mast 3 at the frontward tilt restriction angle. Even if the operator has manipulated the tilt lever 13 for the frontward tilt operation, therefore, the mast 3 automatically stops at the frontward tilt restriction angle that is determined by the then height and load of the fork 8, and cannot tilt beyond this frontward tilt restriction angle. This will not bring about an instable state of the vehicle such as the rear wheels being lifted up, which may occur when the mast 3 is tilted too frontward irrespective of the fork's being at the high position and the mast's being heavily loaded.

(B) The automatic horizontal halt control on the fork will be explained below.

The CPU 57 carries out this automatic horizontal halt control when the operator manipulates the tilt lever 13 to set the fork 8 in the horizontal direction while depressing the operation switch 16 provided on the knob 13*b*. From the detection value of the potentiometer 18 when the tilt lever 13 is manipulated and depending on which one of the detection switches 14 and 15 is enabled, the CPU 57 determines if the tilt lever 13 has been manipulated to set the fork 8 horizontal. While the mast 3 is tilting in the direction the tilt lever 13 has been manipulated, the CPU 57 monitors the tilt angle based on the detection signal from the potentiometer 18. When the tilt angle reaches the horizontal set angle, the CPU 57 executes the halt control to stop the mast 3. Specifically, the CPU 57 stops the current flowing to the proportional solenoid valve 38 to close the control valve 37, thereby stopping the mast 3 at the horizontal set angle. With the operator merely manipulating the tilt lever 13 to set the fork 8 horizontal while depressing the operation switch 16, therefore, the mast 3 automatically stops when the fork 8 comes to the horizontal position. Even when it is difficult to grasp the poise angle of the fork 8 from the driver's seat 10 (for example, when the fork 8 is at a high position), therefore, the fork 8 can accurately be set horizontal. This facilitates the subsequent work.

(C) The rearward tilt speed control on the mast will now be discussed.

The CPU 57 carries out this rearward tilt speed control when the tilt lever 13 is manipulated for the rearward tilt operation and the rearward tilt detection switch 15 is set on. The CPU 57 determines the position when the height sensor 17 is set on as a high elevation height, and the position when the height sensor 17 is set off as a low elevation height. The value of the current flowing in the proportional solenoid valve 38 is set to In (e.g., the maximum current value) for the low elevation height, and set to Im (In>Im) for the high elevation height.

At the low elevation height, therefore, the control valve 37 is set to the maximum open angle and the mast 3 tilts rearward at the normal speed. At the high elevation height, by contrast, the control valve 37 is set to the middle open angle and the mast 3 tilts rearward at a speed slower than the normal speed. As the mast 3 tilts rearward at the normal speed in the case of the low elevation height, the work efficiency is not impaired. As the mast 3 tilts rearward at a speed slower than the normal speed in the case of the high elevation height, the load carrying speed does not get too fast so that there is nothing to worry about falling of the load even when the load on the fork 8 is at a high position. Further, the inertial force acting on the mast 3 at the rearward inclination time does not become excessively large. Although the mast 3 is decelerated by the shock absorb control to be discussed later immediately before the rearward tilting of the mast 3 ends, this restriction on the rearward tilt speed in the case of the high elevation height also contributes to absorbing shocks when the rearward tilting of the mast 3 ends.

(D) The shock absorbing control on the mast will be explained below.

The CPU 57 executes this shock absorb control by interruption while performing the aforementioned controls (A), (B) and (C). In executing each of those controls, the CPU 57 calculates the deceleration start angle for the halt angle in each control. At the frontward inclination time, for example, an angle lying more on the rearward inclination side than the halt angle (the frontward tilt restriction angle, the horizontal set angle) by a predetermined angle which is determined from the frontward tilt speed is calculated as the deceleration start angle. At the rearward inclination time, an angle lying more on the frontward inclination side than the halt angle θs by a predetermined angle which is determined from the rearward tilt speed according to the then elevation height as shown in FIG. 6, i.e., θ1 for the low elevation height or θ2 for the high elevation height is calculated as the deceleration start angle.

While the mast 3 is tilting in the direction the tilt lever 13 has been manipulated, the CPU 57 monitors the tilt angle based on the detection signal from the potentiometer 18. When the tilt angle reaches the deceleration start angle, the CPU 57 gradually decelerates the tilt speed of the mast 3. That is, the CPU 57 reduces the value of the current flowing to the proportional solenoid valve 38 at a given slope so that the current becomes the valve-closing current Io at the halt angle (the frontward tilt restriction angle in the frontward tilt angle restriction control, the horizontal set angle in the automatic horizontal halt control, and the rearward tilt restriction angle (end angle) in the rearward tilt speed control). When the halt control on the mast 3 is carried in this manner, the mast 3 is decelerated immediately before stopping and is then stopped, so that shocks are avoided at the time the mast 3 stops.

(1) As described above, the hydraulic circuit embodying this invention has the tilt control valve 29 and the electromagnetic valve 39 disposed in series on the hydraulic passage for the tilt cylinder 9 to control the tilt system. Even if the tilt control valve 29 sticks due to thermal expansion of the spool and body originated from a rise in the temperature of the hydraulic fluid or a foreign matter in the oil entered between the spool and body, therefore, the operator can accomplish valve switching by manipulating the tilt lever 13 with a little stronger force. With this control system, the situation where tilting the mast is disabled due to sticking of the valve even when the tilt lever is manipulated becomes less likely to occur as compared with the conventional electric control system discussed earlier.

(2) As the lift control valve 28 and the tilt control valve 29 are the same manual check valves as used in the typical mechanical control system, the improvement is easily accomplished by merely providing the electromagnetic valve 39 in series with the tilt control valve 29 on the hydraulic passage of the tilt cylinder 9, as compared with the case of employing the electric control system. This simplifies the structure of the hydraulic circuit and demands fewer design modification. To accomplish speed control, the electric control system requires a separate electromagnetic valve for flow-rate control in addition to an electromagnetic changeover valve, whereas this embodiment shares a single electromagnetic valve 39 for both halt control and speed control and thus needs fewer electromagnetic valves than the electric control system does. This contributes to simplifying the structure of the hydraulic circuit and the structure of the control system and suppressing dissipation power by the reduced number of electromagnetic valves. Furthermore, the components which are normally used in the mechanical control system including the control valves 28 and 29 can be utilized.

(3) In addition, the electromagnetic valve 39 which is a single electromagnetic proportional control valve comprised of the control valve 37 and proportional solenoid valve 38 is used, two kinds of controls, namely the halt control and speed control on the mast 3, can be executed with the single electromagnetic valve 39 alone.

(4) Further, as the proportional solenoid valve 38 is used to control the pilot pressure that actuates the control valve 37, a smaller solenoid current than is needed in the structure which uses a direct acting electromagnetic valve suffices to actuate the electromagnetic valve 39. This can lead to smaller dissipation power of the electromagnetic valve 39.

(5) Moreover, the proportional solenoid valve 38 is of a normally closed type, which should be supplied with the current only when the tilt lever 13 is manipulated, the dissipation power can be reduced.

(6) Force to tilt the mast 3 frontward inherently acting on the mast 3 due to the weight of the fork 8, the load or the like, and the electromagnetic valve 39 (i.e., the control valve 37) is provided on the pipe 36*a* connected to the rod chamber 9*d* where the compression pressure produced by the weight of the mast 3 tilting forward is applied. Accordingly, the hydraulic fluid to which the compression pressure produced by the weight of the mast 3 is applied is drained to tilt the mast 3 forward. This ensures easy acquisition of the positioning precision when the mast 3 is stopped at a predetermined halt angle. That is, the mast 3 can be stopped at the frontward tilt restriction angle or the horizontal set angle at a high positioning precision.

(7) Because the frontward tilt angle restriction control for restricting the frontward tilt angle of the mast 3 in accordance with the elevation height and the load is performed as one halt control to stop the mast 3 by controlling the electromagnetic valve 39, it is possible to avoid an unstable state of the vehicle such as lifting of the rear wheels.

(8) As one halt control to stop the mast 3 by controlling the electromagnetic valve 39, the automatic horizontal halt control for stopping the fork 8 horizontally when the operator manipulates the tilt lever 13 while depressing the operation switch 16 is executed, the fork 8 can accurately be set horizontal even when the fork 8 is placed at the position where it is difficult to grasp the poise angle of the fork 8. This can make the subsequent work easier.

(9) Since the rearward tilt speed control for restricting the rearward tilt speed of the mast 3 when the elevation height is high is carried out as one halt control to stop the mast 3 by controlling the electromagnetic valve 39, it is possible to move the fork 8 at the proper speed to prevent the load on the fork 8 from falling regardless of the elevation height. Further, the inertial force, which acts on the mast 3 when the mast 3 is tilted rearward at a high elevation height, does not become excessively large, thus contributing to absorbing shocks when the rearward tilting of the mast 3 ends.

(10) As the shock absorb control to decelerate the mast 3 before the halt angle is performed as one way to control the speed of the mast 3 by controlling the electromagnetic valve 39, it is possible to absorb shocks at the time the mast 3 is stopped. That is, the shocks that are produced when the mast 3 stops at the frontward tilt restriction angle, the horizontal set angle or the rearward tilt end angle can be absorbed. In particular consideration of the work efficiency, this feature is considerably effective in absorbing shocks when the mast 3 is stopped in the rearward inclination mode where the mast's tilt speed is relatively fast.

(11) As the pilot check valve 43 is provided on the pipe 36*a* which connects to the rod chamber 9*d* which receives the compression pressure produced by the weight of the mast 3 that works in the direction of frontward inclination, at a position closer to the tilt cylinder 9 than the electromagnetic valve 39 (i.e., the control valve 37), the amount of natural forward inclination of the mast 3 at the key-off time can be reduced.

(12) At the key-off time, the electromagnetic valve 39, which is a normally closed valve, and the pilot check valve 43 block the pipe 36*a*, it is possible to prevent the mast 3 from tilting frontward even when any person accidentally manipulates the tilt lever 13 at the key-off time. This purpose is achieved even when one of those valves 39 and 43 fails.

(13) Because the pilot check valve 34 is provided on the pipe 30 which connects the bottom chamber 4*a* of the lift cylinder 4 to the lift control valve 28, it is possible to prevent the fork 8 from moving downward even when any person accidentally manipulates the lift lever 12 at the key-off time. The natural fall of the fork 8 at the key-off time can also be prevented.

A normally open valve may be used for the electromagnetic valve 39, so that the current should be supplied there only in the halt control (fully closed), the rearward tilt speed control (half open) and the shock absorb control. This structure can reduce dissipation power of the proportional solenoid valve 38 more than the structure of the first embodiment. If the electromagnetic valve 39 is a normally open valve, the mast 3 can be tilted in the same way as done in the mechanical control system by manipulating the tilt lever 13 even when the electric control system fails.

The pilot check valve 43 may be omitted. Although this structure reduces the effect of reducing the amount of natural frontward inclination of the mast 3 somewhat, it allows the hydraulic passage (pipe 36*a*) to be blocked by the electromagnetic valve 39 of a normally closed type, so that the mast 3 does not tilt frontward even when any person accidentally manipulates the tilt lever 13 at the key-off time. In the structure where the pilot check valve 82 omitted, an electromagnetic valve 71 may be comprised of a normally closed valve to fully close the control valve 72 when the on-off valves 73 and 74 are both off, so that the mast 3 does not tilt frontward even when any person manipulates the tilt lever 13 at the key-off time.

Second Embodiment

A second embodiment of this invention will now be discussed with reference to FIG. 7.

In this embodiment, an electromagnetic valve which is to be provided in series to the tilt control valve is comprised of a control valve which can switch the hydraulic passage of the tilt cylinder to a plurality of angle states, and a plurality of on-off valves which are so combined as to be able to switch the pilot pressure for actuating this control valve to a plurality of levels. Specifically, as there are three states of angles of the electromagnetic valve necessary to control the tilt system, i.e., the fully closed state, half open state and fully open state (in the case where deceleration control at a given slope is not carried out in the shock absorbing control), a plurality of on-off valves which are so combined as to be able to switch the pilot pressure to the required three levels are used as a pilot-pressure controlling valve in place of the proportional solenoid valve. The following description of this embodiment mainly covers the structural differences from that of the first embodiment, and like or same reference numerals will be used for the components which are identical or equivalent to those of the first embodiment with the intention of avoiding their redundant descriptions.

Figure 7:
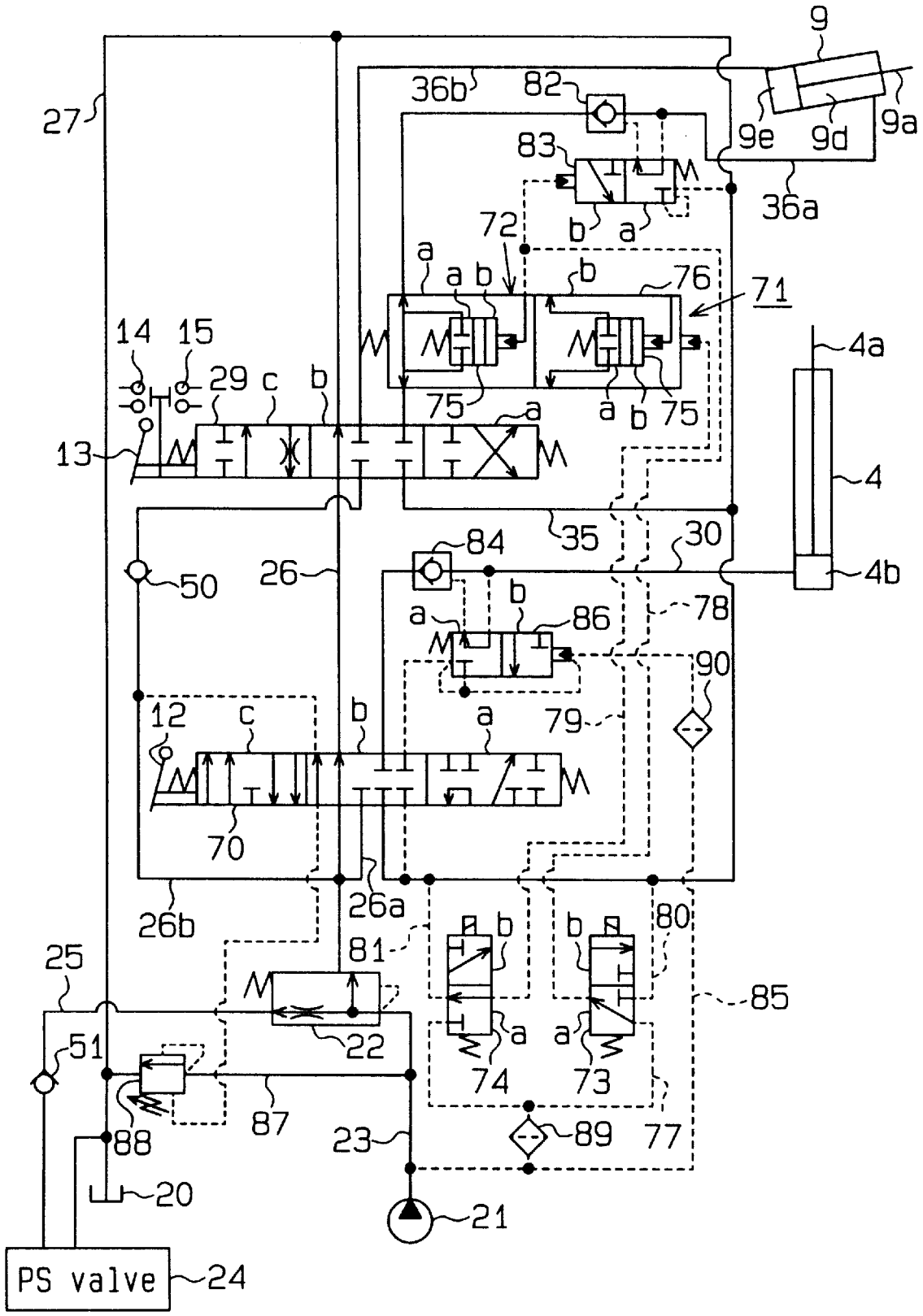
FIG. 7 is a hydraulic circuit diagram of a forklift illustrating a second embodiment of this invention.

FIG. 7 shows a hydraulic circuit in this embodiment.

In this embodiment too, a lift control valve 70 comprised of a manual changeover valve, and the tilt control valve 29 are provided in series on the hydraulic fluid supply pipe 26 which serves to return the hydraulic fluid, expelled from the hydraulic pump 21 and distributed by the flow divider 22, to the return pipe 27. The lift control valve 70 in this embodiment is a 9-port, 3-position changeover valve.

The hydraulic passage for actuating the tilt cylinder 9 includes the branch pipe 26*b*, the pipes 36*a* and 36*b* and the exhaust pipe 35. When the tilt control valve 29 is switched to the state a or b, the hydraulic fluid from the branch pipe 26*b* is supplied to one chamber 9*d* (9*e*) of the tilt cylinder 9 through either the pipe 36*a* or 36*b*, and the hydraulic fluid discharged from the other chamber 9*e* (9*d*) travels through the other one of the pipes 36*a* and 36*b* and is discharged to the oil tank 20 via the exhaust pipe 35 and the return pipe 27. An electromagnetic valve 71 is provided on the pipe 36*a* connected to the rod chamber 9*d*. The electromagnetic valve 71 comprises a control valve 72 on the pipe 36*a*, which is capable of opening and closing the flow passage of the pipe 36*a*, and two on-off valves (2-position changeover valves) 73 and 74 which change the pilot pressure for the actuation of the control valve 72 step by step (three steps in this embodiment).

The control valve 72 incorporates two changeover valves 75 and 76, and can be switched to three states of fully closed, half open and fully open by combinations of the switching positions of the changeover valves 75 and 76. Specifically, the control valve 72 is fully closed when the first changeover valve 75 is at the state a and the second changeover valve 76 is at the state b, is half open when the first changeover valve 75 is at the state b and the second changeover valve 76 is at the state b, and is fully open when the first changeover valve 75 is at the state b and the second changeover valve 76 is at the state a.

The two on-off valves 73 and 74 are connected to a pipe 77 which transmits the discharge pressure of the hydraulic pump 21. The first on-off valve 73, connected to a first changeover valve 75 by a pipe 78, controls the pilot pressure for actuating the first changeover valve 75. The second on-off valve 74, connected to a second changeover valve 76 by a pipe 79, controls the pilot pressure for actuating the second changeover valve 76. The first on-off valve 73, which is a normally open valve, supplies the discharge pressure (pilot pressure) from the hydraulic pump 21 to the first changeover valve 75 at a state a (off state), and connects the pipe 78 to a pipe 80 which is linked to the return pipe 27, at a state b (on state). The second on-off valve 74, which is a normally closed valve, connects the pipe 79 to a pipe 81 which is linked to the return pipe 27, at a state a (off state), and supplies the discharge pressure (pilot pressure) from the hydraulic pump 21 to the second changeover valve 76 at a state b (on state).

A pilot check valve 82 for reducing the amount of natural tilting of the tilt cylinder 9 at the key-off (engine stopped) time is provided on the pipe 36*a*, at a position closer to the tilt cylinder 9 than the control valve 72. A changeover valve 83 which is actuated with the output pilot pressure of the first on-off valve 73 serves to change the pilot pressure for actuating the pilot check valve 82.

A second pilot check valve 84 for preventing the natural fall of the lift cylinder 4 at the key-off (engine stopped) time is provided on the pipe 30. A changeover valve 86 which is actuated with the discharge pressure of the hydraulic pump 21 as the pilot pressure, which is transmitted through a pipe 85, serves to change the pilot pressure for actuating the pilot check valve 84. This pilot check valve 84 has a function to prevent the fork 8 from lowering even when any person accidentally manipulates the lift lever 12 at the key-off time.

A relief valve 88 is provided on a pipe 87 which connects the pipe 23 to the return pipe 27. This relief valve 88 serves to let the hydraulic fluid escape so that the upstream hydraulic pressure does not exceed the set pressure, when the tilt control valve 29 or the lift control valve 70 is switched to the state to block the flow passage of the hydraulic fluid supply pipe 26. Filters 89 and 90 serve to eliminate foreign matters in the fluid.

The controller 53 basically has the same structure as that of the first embodiment, and the CPU 57 performs ON/OFF control on the current to flow through the two on-off valves 73 and 74 by means of the solenoid driver 56. For a predetermined time (about a couple of seconds) immediately after key-on (engine started), the pilot check valves 82 and 84 are open so that even when the tilt lever 13 is manipulated, the on-off valves 73 and 74 are forcibly held at the off state. In this embodiment, all the controls which are carried out by the CPU 57 in the first embodiment, but the shock absorbing control, are executed.

This hydraulic circuit operates as follows. At the key-off time (engine stopped), the on-off valves 73 and 74 are both at the off (deexcited) state. The changeover valves 83 and 86 are both at the state a, and the pilot check valves 82 and 84 are held closed by the hydraulic pressures in the chambers 9*d* and 4*b*. The control valve 72 is at the state shown in FIG. 7 where the changeover valves 75 and 76 are both at the state a.

When the key is set on (the engine is started) and the hydraulic pump 21 is driven, as the first on-off valve 73 is at the open state to connect the pipes 77 and 78 together, its discharge pressure is transmitted through the pipes 77 and 78 to set the changeover valve 83 to the state b from the state a, and the discharge pressure is transmitted through the pipe 85 to set the changeover valve 86 to the state b from the state a. As a result, the hydraulic pressures from the chambers 9*d* and 4*b*, which have been applied to the pilot check valves 82 and 84, are gone, opening both pilot check valves 82 and 84 and holding them open. Further, the discharge pressure is also applied to the first changeover valve 75, setting the control valve 72 to the full open state where both changeover valves 75 and 76 are open.

To conduct all the controls carried out in the first embodiment, except the shock absorbing control, the angle of the control valve 72 has to be switched to three states of fully closed, half open and fully open. That is, the control valve 72 should be fully closed to accomplish the halt control in the frontward tilt angle restriction control or the automatic horizontal halt control, and it should be set half open or fully open in accordance with the elevation height in order to perform the speed control in the rearward tilt speed control. In this embodiment, the switching of the electromagnetic valve 71 to three angle states is accomplished by using the control valve 72 and the two on-off valves 73 and 74.

Normally, the on-off valves 73 and 74 are both set off and the control valve 72 is held fully open. The CPU 57 sets at least one of the on-off valves 73 and 74 on only when the control valve 72 is fully closed to stop the mast 3 under the halt control and when the control valve 72 is half opened in the rearward inclination of the mast 3 at a high elevation height.

To fully close the control valve 72 to stop the mast at a predetermined halt angle in the frontward tilt angle restriction control or the automatic horizontal halt control, the CPU 57 sets both the first on-off valve 73 and the second on-off valve 74 on. As a result, the first on-off valve 73 is switched to the state b from the state a to connect the pipes 78 and 80 together, releasing the discharge pressure that has been applied to the first changeover valve 75 and thus closing the valve 75. At the same time, the second on-off valve 74 is switched to the state b to connect the pipes 77 and 79 together, so that the second changeover valve 76 is closed by the discharge pressure. Consequently, the control valve 72 becomes fully closed. At this time, the discharge pressure that has been applied to the changeover valve 83 is gone, causing the pilot check valve 82 to be closed, which does not matter because the control valve 72 is fully closed.

To open the control valve 72 halfway at a high elevation height in the rearward tilt speed control, the CPU 57 sets the first on-off valve 73 off and the second on-off valve 74 on. As a result, the first on-off valve 73 is switched to the state a, thereby opening the first changeover valve 75. At the same time, the second on-off valve 74 is switched to the state b from the state a, closing the second changeover valve 76. This sets the control valve 72 half open.

In this embodiment, as the electromagnetic valve 71 provided in the hydraulic passage of the tilt system is comprised of the control valve 72 and two the on-off valves 73 and 74, the electromagnetic valve 71 can be switched to the required three angle states. The use of the on-off valves 73 and 74 eliminates the need for the pressure reducing valve 33 and the proportional solenoid valve 38 which are essential in the first embodiment, and can thus simplify the hydraulic circuit. Further, the ON/OFF control can make the control by the CPU 57 simpler. According to the electric control system as discussed in the Background of the Invention, when the electric control system fails, the mast cannot be moved even by manipulating the tilt lever. According to this embodiment, by contrast, when the electric control system for controlling the electromagnetic valve 71 fails to disable the ON actions of the on-off valves 73 and 74, the control valve 72 is fully open at this time so that the mast 3 can be tilted through the mechanical control system by switching the tilt control valve 29 by manipulating the tilt lever 13. Although deceleration for shock absorption is not performed when rearward inclination ends, the rearward tilt speed of the mast 3 is restricted at a high elevation height so that shocks at the time rearward inclination ends are absorbed to some degree.

Figure 8:
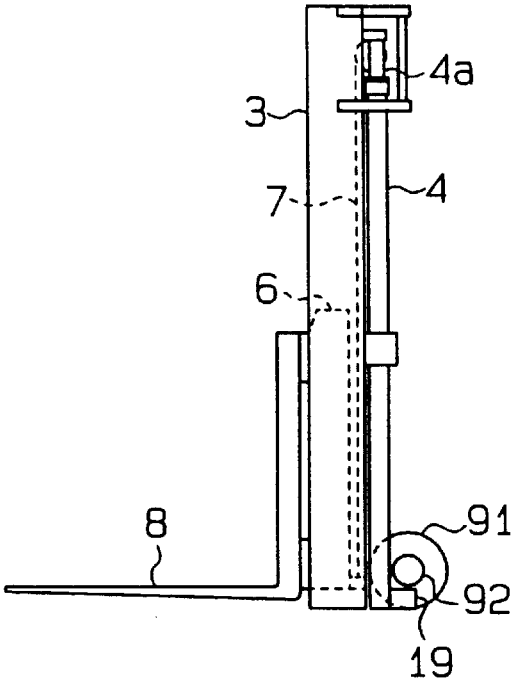
FIG. 8 is a partial side view of a forklift equipped with a height sensor according to a modification of the second embodiment.
Figure 9:
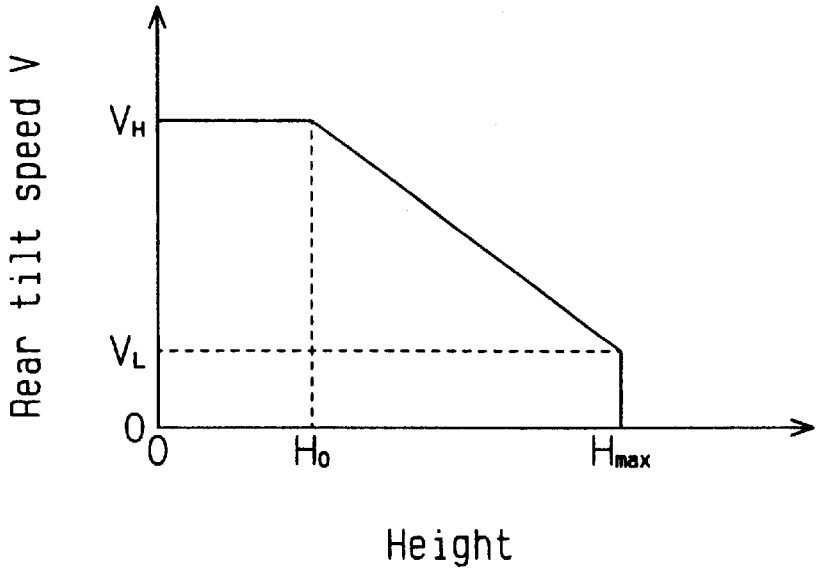
FIG. 9 is a chart showing a map for rear-tilt-angle regulation control according to this modification.

As shown in FIG. 8, a height sensor 92 of a type which detects the rotation of a reel 91 may be used. The reel 91 is urged in a direction where the wire coupled to the fork 8 and the inner mast 3*b* can be taken up, and the height sensor 92 detects the take-up amount of the reel 91 to continuously detect the elevation height. A map for acquiring the rearward tilt speed according to the elevation height, as shown in FIG. 9, for example, should be prepared and stored in a ROM or the like. This map shows that the rearward tilt speed (maximum rearward tilt speed) $V_H$ equivalent to the fully open state of the electromagnetic valve is set in a low elevation height lower than a predetermined height Ho, the rearward tilt speed V continuously decreases (i.e., the angle of the electromagnetic valve is continuously narrowed) in a high elevation height equal to or higher than the height Ho, as the elevation height increases, and the rearward tilt speed is set to $V_L$ (minimum rearward tilt speed) at a maximum elevation height Hmax. The rearward tilt speed of the mast 3 can be set more finely in accordance with the height by continuously changing the current value of the proportional solenoid valve 38 based on this map and in accordance with the height. Further, the structure may be modified in such a way that the map of the frontward tilt restriction angle is set to continuously change with respect to both the height and load, and the frontward tilt restriction angle is controlled more finely based on the height value continuously detected by the height sensor 92 and the load value continuously detected by the pressure sensor 19. Note that the height sensor 92 is not restrictive, but any other sensor capable of continuously detecting the height can be used as well.

Third Embodiment

A third embodiment of this invention will now be discussed with reference to FIGS. 10 and 11. In this embodiment, electromagnetic proportional control valves are used to control the lift cylinder 4 and the tilt cylinder 9.

Figure 10:
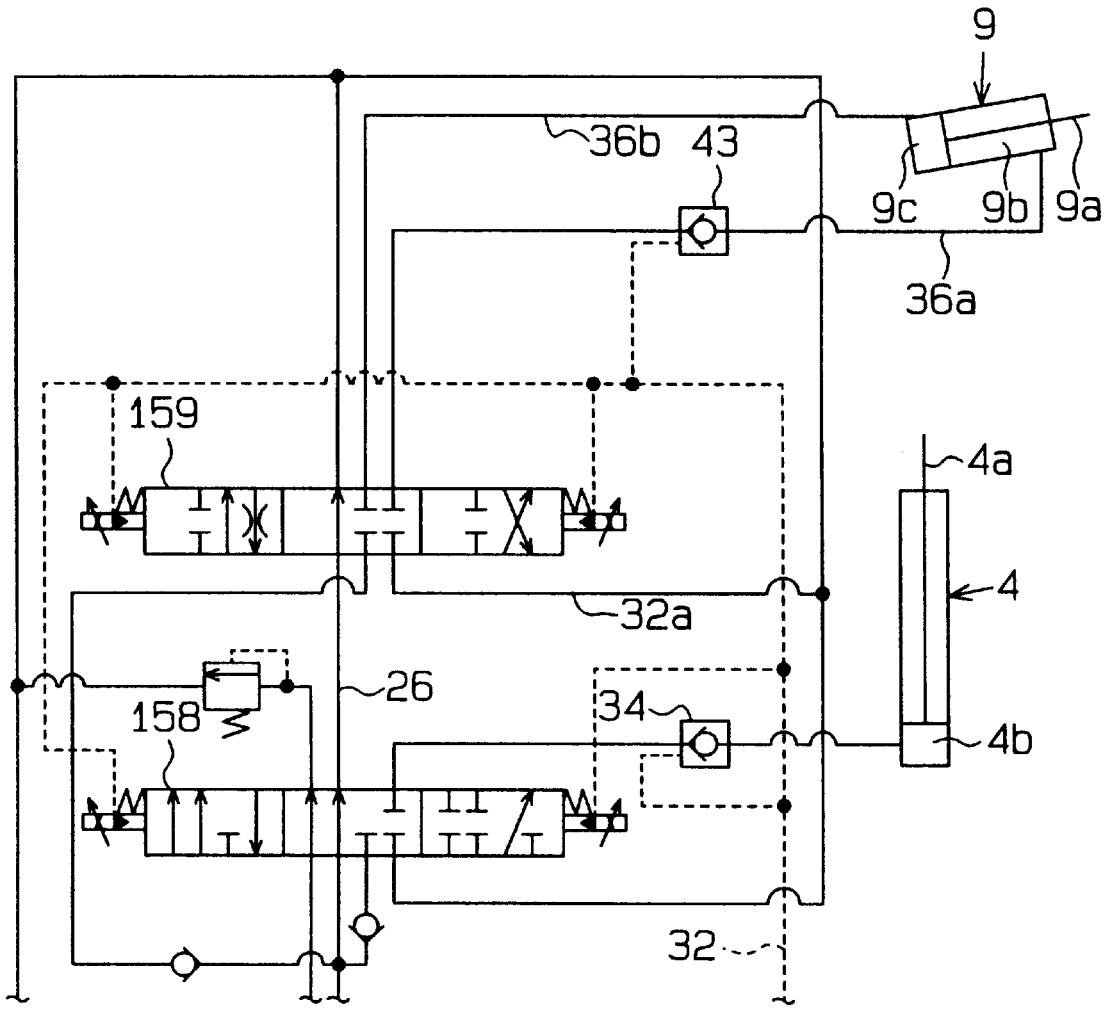
FIG. 10 is a hydraulic circuit diagram of a forklift illustrating a third embodiment of this invention.

As shown in FIG. 10, an electromagnetic proportional lift control valve 158 is provided in place of the manual lift control valve, and an electromagnetic proportional tilt control valve 159 is provided in place of the manual tilt control valve.

Figure 11:
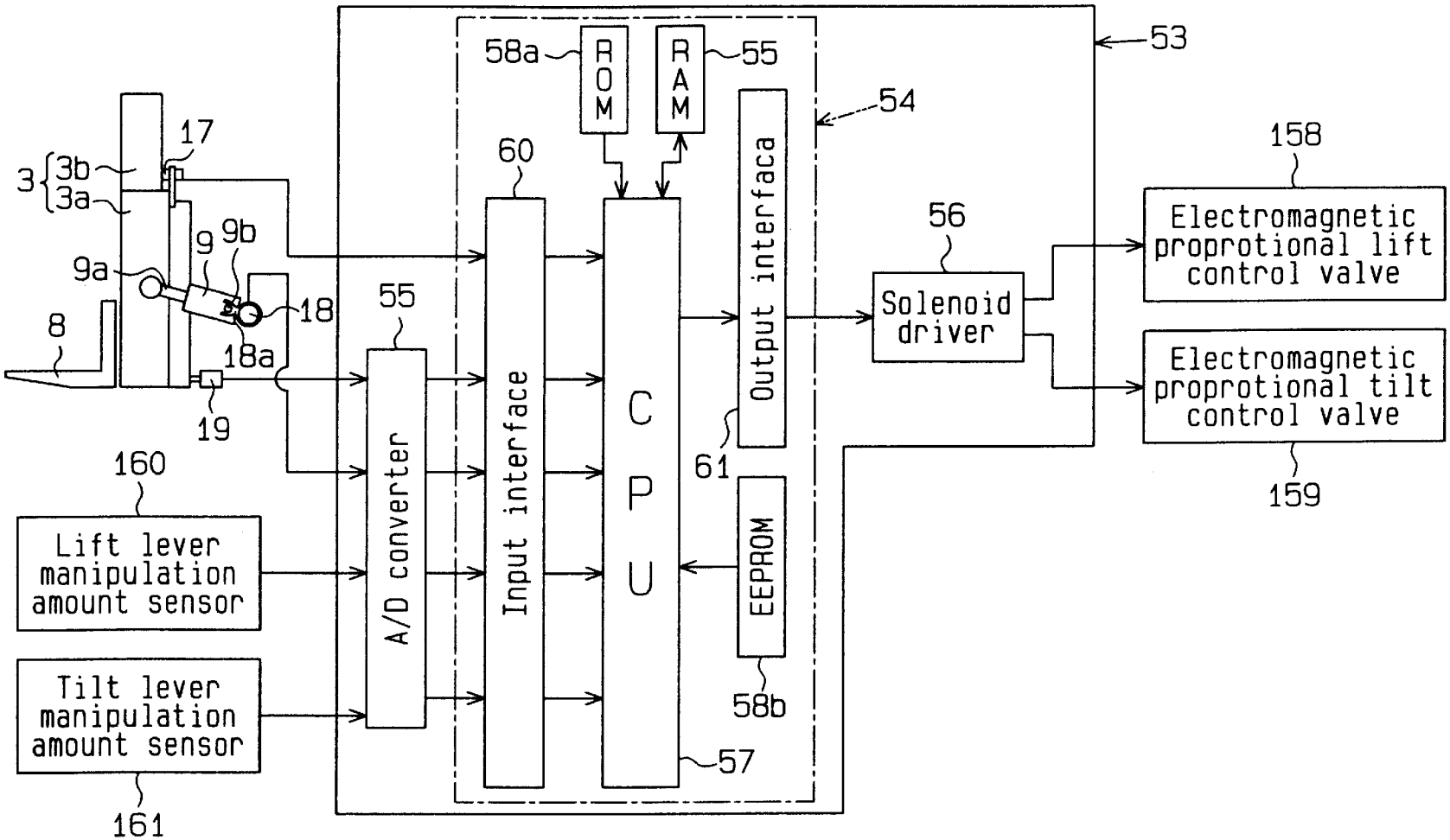
FIG. 11 is a block circuit diagram showing the electric structure of the third embodiment.

As shown in FIG. 11, connected to the controller 53 are a lift lever manipulation amount sensor 160 for detecting the amount of manipulation from the neutral position of the lift lever and a tilt lever manipulation amount sensor 161 for detecting the amount of manipulation from the neutral position of the tilt lever. Both sensors 160 and 161 are designed to output detection signals corresponding to the displacement amounts from the neutral positions of the associated levers, and, for example, potentiometers are used for those sensors in this embodiment.

Based on the output signal of the lift lever manipulation amount sensor 160, the CPU 57 computes the angle of the electromagnetic proportional lift control valve 158 corresponding to that signal. Then, the CPU 57 sends a control signal to the electromagnetic proportional lift control valve 158 via the driver 56 so as to set the control valve 158 to that angle. As a result, the electromagnetic proportional lift control valve 158 is controlled to the angle corresponding to the manipulation amount of the lift lever.

Based on the output signal of the tilt lever manipulation amount sensor 161, the CPU 57 computes the angle of the electromagnetic proportional tilt control valve 159 corresponding to that signal. Then, the CPU 57 sends a control signal to the electromagnetic proportional tilt control valve 159 via the driver 56 so as to set the control valve 159 to the computed angle. Consequently, the electromagnetic proportional tilt control valve 159 is controlled to the angle corresponding to the manipulation amount of the tilt lever, and the mast 3 is tilted at a speed corresponding to the angle. When the tilt lever is manipulated for the frontward inclination, the CPU 57 runs the frontward tilt angle restriction control program. The CPU 57 sequentially calculates the tilt angle of the mast 3 based on the output signal of the tilt lever manipulation amount sensor 161 and compares the computation result with the maximum allowable frontward tilt angle. When the difference becomes 0, the CPU 57 sends an instruction signal to set the angle of the electromagnetic proportional tilt control valve 159 to 0 even when a frontward tilt signal is output from the sensor 161. Consequently, the mast 3 stops at the position of the maximum allowable frontward tilt angle.

Fourth Embodiment

Figure 12:
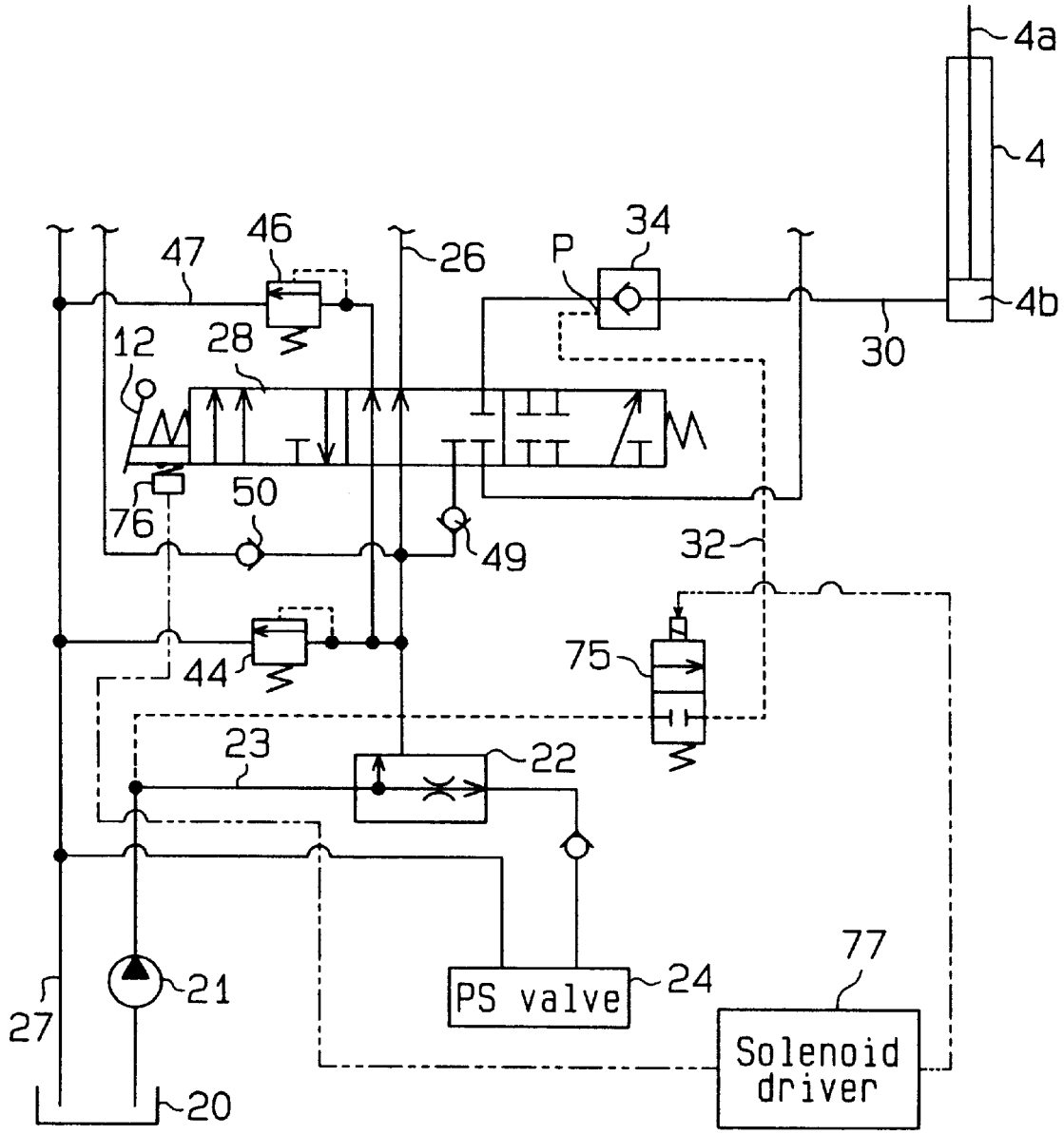
FIG. 12 is a hydraulic circuit diagram depicting a fourth embodiment of this invention.

A fourth embodiment of this invention will now be discussed referring to FIG. 12. This embodiment is mainly directed to the control of the lift cylinder 4. Even when the hydraulic pump 21 is driven, supply of the pilot pressure to the pilot check valve 34 can be stopped.

An electromagnetic valve 75 is disposed in a midway in the pipe 32. The electromagnetic valve 75 is held open when set on (excited) and is held closed when set off (deexcited). The electromagnetic valve 75 supplies the pilot pressure to open the pilot check valve 34 only when the lift control valve 28 is actuated for the lift-down operation.

A micro switch 76 as lift-down detection means for detecting the lift-down operation of the lift control valve 28 is provided in the vicinity of the lift lever 12. The micro switch 76 is set on only when the lift lever 12 is set to the position of the lift-down operation. The micro switch 76 is electrically connected to a solenoid driver 77 which supplies an excitation current to the electromagnetic valve 75. The solenoid driver 77 supplies the excitation current to the electromagnetic valve 75 when the micro switch 76 is on, and stops supplying the excitation current when the micro switch 76 is off.

The hydraulic pump 21 is driven by the engine E. This causes the pilot pressure to be supplied to the check valve 34 to lower the fork. With the lift control valve 28 set to the neutral position, therefore, the load to be applied to the hydraulic fluid of the bottom chamber 4*b* of the lift cylinder 4 directly acts on the lift control valve 28. The lift control valve 28 is constituted of a spool valve from whose slide surface the hydraulic fluid gradually leaks while large pressure is applied to the spool valve. As a result, the lift control valve 28 is set to the neutral position with the fork 8 placed at an elevated position, and the fork 8, if left under this situation, falls naturally.

When the electromagnetic valve 75 is at the off state, however, the pilot pressure is not supplied to the pilot check valve 34 even while the hydraulic pump 21 is driven, the check valve 34 is so held as to inhibit the flow of the hydraulic fluid to the lift control valve 28 from the bottom chamber 4*b*. As the electromagnetic valve 75 is set on only when the control valve 28 is actuated to the position of the lift-down operation, the check valve 34 is kept blocking the pipe 30 with the control valve 28 is set to the neutral position. Accordingly, the hydraulic pressure in the bottom chamber 4*b* of the lift cylinder 4 does not act on the control valve 28 and the hydraulic fluid hardly leaks from the control valve 28, reducing the amount of natural fall of the fork 8.

Fifth Embodiment

Figure 13:
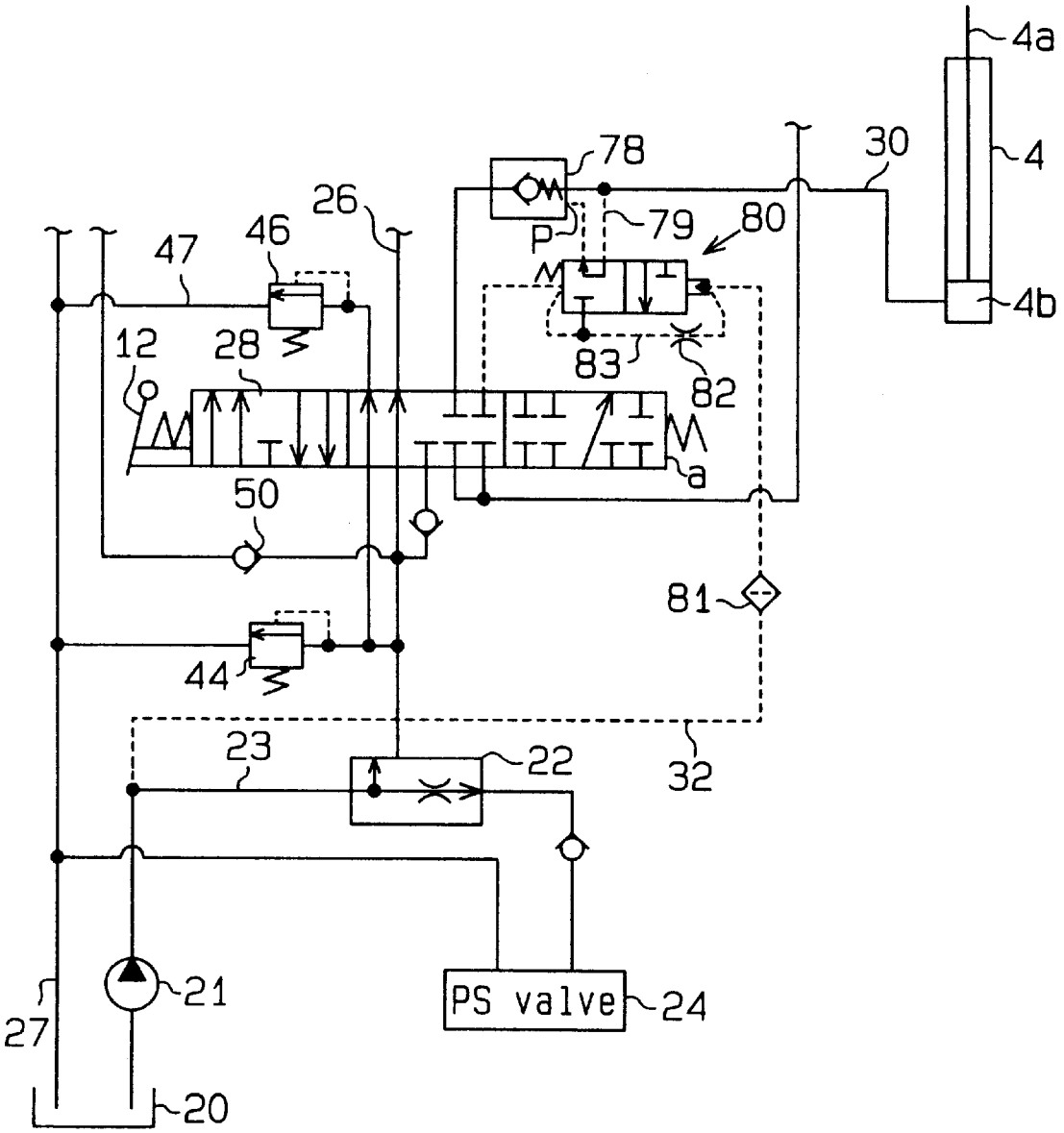
FIG. 13 is a hydraulic circuit diagram illustrating a fifth embodiment of this invention.

A fifth embodiment of this invention will now be discussed referring to FIG. 13. This embodiment is also intended to prevent the natural fall of the lift cylinder 4. That is, the pilot check valve is not opened even while the hydraulic pump 21 is driven, unless the lift control valve 28 is set to the lift-down position.

A pilot check valve 78 is provided in the pipe 30. Although the check valve 34 is opened when supplied with the pilot pressure to thereby permit the flow in the reverse direction in the previously described embodiments, the pilot check valve 78 used in this embodiment inhibits the reverse flow when supplied with the pilot pressure and permits the reverse flow when no pilot pressure is supplied. The pressure in the bottom chamber 4*b* of the lift cylinder 4 is used as the pilot pressure to the check valve 78, and a pilot-pressure supplying pipe 79 branched from the pipe 30 is connected to a pilot-pressure supply port P of the pilot check valve 78.

The supply or block (release) of the pilot pressure to the check valve 78 is controlled by a logic valve 80 provided in a midway in the pipe 32. The lift control valve 28 in use is a 9-port, 3-position changeover valve. A filter 81 is provided in the pipe 29 upstream of the logic valve 80.

The logic valve 80, which is a 3-port, 2-position changeover valve, is designed to supply the pilot pressure to both sides of the spool via a passage 83 which has an orifice 82. With the pressures acting on both sides of the spool in balance, the pilot-pressure supply port P of the pilot check valve 78 is held connected to the bottom chamber 4*b* of the lift cylinder 4 via the pipe 79, as illustrated. The logic valve 80, when connected to the lift control valve 28, is so held as to connect the pilot-pressure supply port P to the oil tank 20.

According to this embodiment, unless the lift control valve 28 is actuated to the lift-down position, the pilot-pressure supply port P of the pilot check valve 78 is connected to the bottom chamber 4*b* so that the pilot pressure is kept supplied, and the check valve 78 comes to the state of restricting (inhibiting) the flow of the hydraulic fluid toward the lift control valve 28 from the bottom chamber 4*b* of the lift cylinder 4. When the lift control valve 28 is actuated to the lift-down position, the pipe 32 is connected to the return pipe 27 and the orifice 83 of the logic valve 80 makes the pressure on the control valve 28 smaller. This moves the spool to connect the port P of the check valve 78 to the oil tank 20. As a result, the check valve 78 comes to the sate of permitting the flow of the hydraulic fluid toward the control valve 28 from the bottom chamber 4*b* of the lift cylinder 4.

With the control valve 28 set to the neutral position, therefore, the hydraulic fluid hardly leaks from the control valve 28, reducing the amount of natural fall of the fork 8 in this embodiment too.

Figure 14:
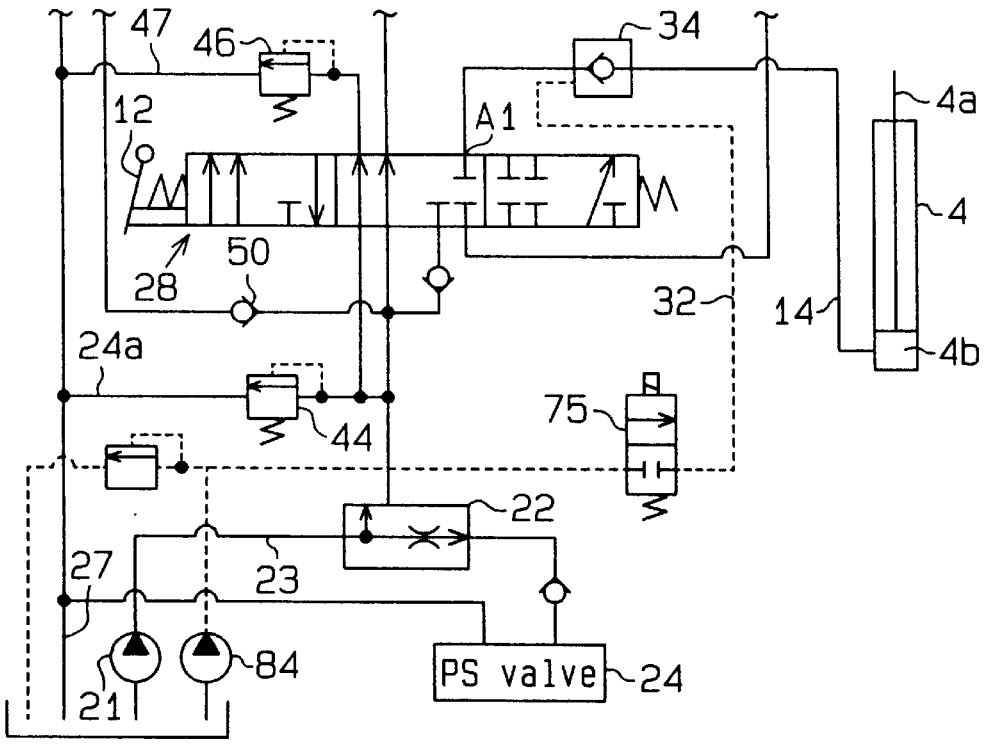
FIG. 14 is a hydraulic circuit diagram showing a modification of the fifth embodiment of this invention.
Figure 15:
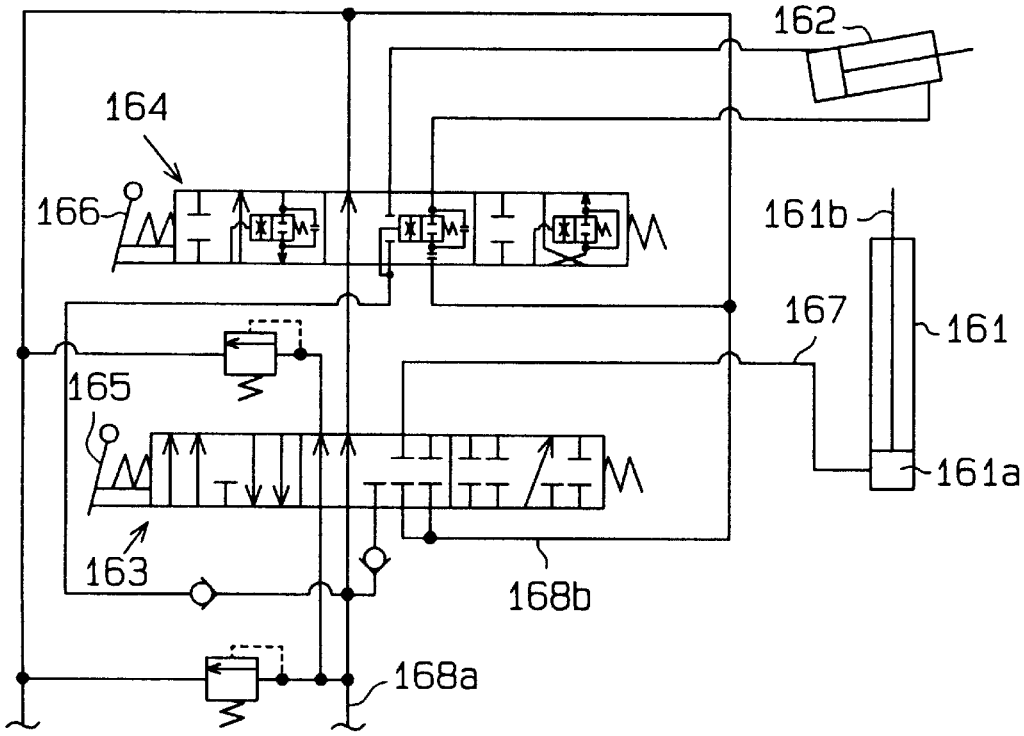
FIG. 15 is a hydraulic circuit diagram of prior art.

FIG. 14 shows a modification of the fifth embodiment. In this modification, the pipe 32 is not branched from the hydraulic fluid supply pipe 26, but it is connected to an independent hydraulic pump 44 provided additionally, as illustrated. The hydraulic pump 44 is driven together with the hydraulic pump 21 by the engine E. When the pilot check valve 34 in use is so designed as to allow the reverse flow when the pilot pressure is supplied there, a relatively large pilot pressure is needed when the fork 8 is carrying a very heavy load. If the case where the pipe 32 is branched from a hydraulic fluid supply pipe 26 which serves as a main pipe to supply the hydraulic fluid to the lift cylinder 4 and the tilt cylinder 9, when most of the pressure of the hydraulic fluid is used for the loading work, the pilot pressure may become insufficient. The separate hydraulic pump 84 for the supply of the pilot pressure can ensure smooth opening of the pilot check valve 34 regardless of the loading work conditions. It is thus preferable to provide a separate hydraulic pump.

What is claimed is:

1. A hydraulic control apparatus for an industrial vehicle for tilting a loading attachment supported on a mast by operating operation means, comprising:

a hydraulic cylinder for tilting a loading attachment;

a changeover valve controlling operation of said hydraulic cylinder;

a fluid passage between the hydraulic cylinder and said changeover valve;

an electromagnetic valve placed between said hydraulic cylinder and said changeover valve, along said fluid passage;

detection means for detecting a value necessary to manipulate said attachment; and control means for controlling said electromagnetic valve based on said detected value.

2. The hydraulic control apparatus according to claim 1, wherein said hydraulic cylinder includes a tilt cylinder extendible and retractable to tilt said mast frontward and rearward, and said operation means is a tilt lever to be manipulated frontward and rearward to extend and retract said tilt cylinder.

3. The hydraulic control apparatus according to claim 2, wherein said electromagnetic valve selectively connects and blocks said hydraulic cylinder and said changeover valve and can regulate a flow rate of pressurized fluid between said hydraulic cylinder and said changeover valve.

4. The hydraulic control apparatus according to claim 3, wherein said electromagnetic valve comprises:

a control valve disposed in series to said changeover valve and to be driven with a pilot pressure; and a proportional solenoid valve for regulating a pilot pressure necessary for actuating said control valve.

5. The hydraulic control apparatus according to claim 2, wherein said electromagnetic valve comprises:

a control valve switchable to a plurality of angle positions; and an assembly comprised of a plurality of valves for switching said control valve to said plurality of angle positions and able to select a pilot pressure step by step.

6. The hydraulic control apparatus according to claim 2, wherein said detection means includes a tilt angle sensor for detecting a tilt angle of said mast.

7. The hydraulic control apparatus according to claim 6, wherein said operation means includes a switch to be operated at a time of stopping said attachment horizontally; and when said switch is operated, said control means closes said electromagnetic valve in such a way as to stop said mast, based on said detected tilt angle, at an angle which sets said attachment horizontal.

8. The hydraulic control apparatus according to claim 6, wherein when recognizing that said mast is immediately before a halt angle based on said detected tilt angle, said control means reduces an angle of said electromagnetic valve to reduce a tilt speed of said mast.

9. The hydraulic control apparatus according to claim 2, wherein said detection means includes a height sensor for detecting a height of said attachment supported on said mast, and a rear tilt sensor for detecting such manipulation of said tilt lever as to tilt said mast rearward; and further comprising:

storage means for storing at least two states of rear tilt speeds of said mast such that said rear tilt speeds become slower as said attachment gets higher, and angles of said electromagnetic valve corresponding to said rear tilt speeds;

selection means for selecting a proper one of said rear tilt speeds of said mast stored in said storage means, based on a height of said attachment; and angle control means for controlling said electromagnetic valve to an angle corresponding to said selected rear tilt speed.

10. The hydraulic control apparatus according to claim 9, wherein said height sensor is capable of continuously detecting said height of said attachment.

11. The hydraulic control apparatus according to claim 9, wherein said height sensor is capable of detecting if said height of said attachment is equal to or greater than a predetermined value.

12. The hydraulic control apparatus according to claim 1, further comprising:

a hydraulic pump:

second operation means for moving said attachment up and down;

a second changeover valve to be switched by said second operation means;

a second hydraulic cylinder to be controlled by said second changeover valve;

a check valve placed between said second hydraulic cylinder and said second changeover valve; and check valve relief means for relieving said check valve only when said hydraulic pump is driven.

13. The hydraulic control apparatus according to claim 12, wherein said second operation means includes a lift lever and said second hydraulic cylinder is a lift cylinder.

14. The hydraulic control apparatus according to claim 13, wherein said check valve is piloted and said check valve relief means is pilot pressure supply means capable of supplying a pilot pressure to said check valve when said hydraulic pump is driven.

15. The hydraulic control apparatus according to claim 14, wherein said pilot pressure supply means has valve means to be controlled to such a state as to be able to supply said pilot pressure to relieve said check valve only when said lift lever is manipulated for a lift-down operation.

16. The hydraulic control apparatus according to claim 15, wherein said check valve restricts a reverse flow with said pilot pressure supplied, and said valve means is a logic valve for holding said check valve to such a state as to connect to an oil tank when said lift lever is manipulated for said lift-down operation.

17. The hydraulic control apparatus according to claim 15, wherein said pilot pressure supply means has a pipe branched from a main pipe for connecting said hydraulic pump to a lift control valve.

18. The hydraulic control apparatus according to claim 17, wherein said check valve permits a reverse flow with said pilot pressure supplied, and an electromagnetic valve to be held open when said lift control valve is at a lift-down operation position and held closed otherwise, based on a detection signal from lift-down detection means for detecting a lift-down operation of said lift control valve is provided in said pipe branched from said main pipe.

19. A hydraulic control apparatus for an industrial vehicle for moving a loading attachment supported on a mast up and down, comprising:

a hydraulic cylinder for moving the loading attachment up and down, said hydraulic cylinder having a first chamber for receiving fluid to cause the mast to move up, and a second chamber;

a changeover valve for controlling said hydraulic cylinder, wherein operation of an operating means switches the changeover valve;

a hydraulic pump for pumping fluid to the first chamber when said pump is driven;

a check valve between said first chamber of said hydraulic cylinder and said changeover valve, said check valve for restricting the flow of fluid from said first chamber due to the load of the mast acting on said first chamber, when said hydraulic pump is not driven; and check valve relief means for relieving said check valve only when said hydraulic pump is driven.

20. The hydraulic control apparatus according to claim 19, wherein said check valve is piloted and said check valve relief means is pilot pressure supply means capable of supplying a pilot pressure to said check valve when said hydraulic pump is driven.

21. The hydraulic control apparatus according to claim 20, wherein said pilot pressure supply means has valve means to be controlled to such a state as to be able to supply said pilot pressure to relieve said check valve only when said lift lever is manipulated for a lift-down operation.

22. The hydraulic control apparatus according to claim 21, wherein said check valve restricts a reverse flow with said pilot pressure supplied, and said valve means is a logic valve for holding said check valve to such a state as to connect to an oil tank when said lift lever is manipulated for said lift-down operation.

23. The hydraulic control apparatus according to claim 22, wherein said pilot pressure supply means has a pipe branched from a main pipe for connecting said hydraulic pump to a lift control valve.

24. The hydraulic control apparatus according to claim 23, wherein said check valve permits a reverse flow with said pilot pressure supplied, and an electromagnetic valve to be held open when said lift control valve is at a lift-down operation position and held closed otherwise, based on a detection signal from lift-down detection means for detecting a lift-down operation of said lift control valve is provided in said pipe branched from said main pipe.

* * * * *

UNITED STATES PATENT AND TRADEMARK OFFICE

CERTIFICATE OF CORRECTION

PATENT NO. : 6,164,415
DATED : December 26, 2000
INVENTOR(S) : Toshiyuki Takeuchi It is certified that error appears in the above-identified patent and that said Letters Patent is hereby corrected as shown below:

Colum 4,
Line 34, please delete "A around" and insert therefor -- Around --
Line 35, please delete " 5' " and insert therefor -- 5, -- and please delete " 3b' " and insert therefor -- 3b, --

Signed and Sealed this

Twenty-first Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,164,415
DATED : December 26, 2000
INVENTOR(S) : Toshiyuki Takeuchi It is certified that error appears in the above-identified patent and that said Letters Patent is hereby corrected as shown below:

Title page,
Item [73], Assignee, add the following:
-- Nishina Industrial Co., Ltd., Toyono-machi, Nagano, Japan --.

Signed and Sealed this

Sixth Day of September, 2005

JON W. DUDAS
*Director of the United States Patent and Trademark Office*